US010041752B2

(12) United States Patent
Ladner

(10) Patent No.: US 10,041,752 B2
(45) **Date of Patent: *Aug. 7, 2018**

(54) UNIVERSAL SYSTEMS AND METHODS FOR ADJUSTABLY LIMITING CAPACITY OF FIREARM MAGAZINES

(71) Applicant: Zachary Daniel Ladner, Martinez, CA (US)

(72) Inventor: Zachary Daniel Ladner, Martinez, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/663,675

(22) Filed: Jul. 28, 2017

(65) Prior Publication Data

US 2018/0023909 A1 Jan. 25, 2018

Related U.S. Application Data

(63) Continuation-in-part of application No. 15/344,898, filed on Nov. 7, 2016, which is a continuation of application No. 14/700,059, filed on Apr. 29, 2015, now Pat. No. 9,488,426, which is a continuation-in-part of application No. 13/429,301, filed on Mar. 23, 2012, now Pat. No. 9,328,982.

(60) Provisional application No. 61/468,072, filed on Mar. 28, 2011, provisional application No. 62/448,946, filed on Jan. 20, 2017.

(51) Int. Cl.

| | |
|---|---|
| ***F41C 23/00*** | (2006.01) |
| ***F41A 9/71*** | (2006.01) |
| ***F41A 9/70*** | (2006.01) |

(52) U.S. Cl.
CPC . *F41A 9/71* (2013.01); *F41A 9/70* (2013.01)

(58) Field of Classification Search
CPC ..... F41A 9/62; F41A 9/71
See application file for complete search history.

(56) References Cited

U.S. PATENT DOCUMENTS

| | | | |
|---|---|---|---|
| 2,026,252 | A | 12/1935 | Russell et al. |
| 2,635,378 | A | 4/1953 | Pinckney et al. |
| 3,371,440 | A | 3/1968 | Cassell |

(Continued)

FOREIGN PATENT DOCUMENTS

WO WO2008132739 A2 11/2008

OTHER PUBLICATIONS

Fletchnuts. <http://www.arl5.com/forums/t_3_17/426869_html>, Feb. 18, 2009.

(Continued)

*Primary Examiner* — Gabriel Klein
(74) *Attorney, Agent, or Firm* — Kang S. Lim

(57) ABSTRACT

The present invention relates to systems and methods for reliably limiting the cartridge loading capacity of firearm magazines. In one embodiment, a magazine capacity limiting assembly includes a limiter body and a limiter base. The magazine capacity limiter body reliably operates with a cartridge follower of a firearm magazine. The limiter body is installed substantially within coils of the magazine's spring, thereby limiting the travel of the follower within the magazine body to limit the magazine's cartridge capacity. The lower portion of the limiter body can include a plurality of extensions is configured to be severed at a corresponding plurality of pre-determined locations corresponding to a plurality of cartridge capacities. The limiter may also include a cupped top configured to be securely coupled the cartridge follower of a corresponding type of firearm.

3 Claims, 34 Drawing Sheets

(56) References Cited

U.S. PATENT DOCUMENTS

| | | | |
|---|---|---|---|
| 3,777,383 | A | 12/1973 | Haines et al. |
| 3,913,251 | A | 10/1975 | Browning |
| 4,139,959 | A | 2/1979 | Howard et al. |
| 5,113,605 | A | 5/1992 | Kim |
| 5,507,110 | A | 4/1996 | Chestnut et al. |
| 5,568,696 | A | 10/1996 | Mauch et al. |
| 5,568,698 | A | 10/1996 | Harding et al. |
| 5,638,626 | A | 6/1997 | Westrom |
| 5,704,148 | A | 1/1998 | Valorose |
| 5,845,426 | A | 12/1998 | Valorose |
| 8,061,071 | B2 | 11/2011 | Fitzpatrick et al. |
| 9,267,749 | B1 | 2/2016 | Dukart |
| 2011/0005113 | A1 | 1/2011 | Fitzpatrick et al. |
| 2011/0030259 | A1 | 2/2011 | Castro et al. |
| 2012/0246988 | A1 | 10/2012 | Ladner |
| 2013/0192115 | A1 | 8/2013 | Calilung |
| 2014/0075808 | A1 | 3/2014 | Ballard |

OTHER PUBLICATIONS

Calguns.net forum thread entitled "Why epoxy magazine blocks". p. 1. Jan. 14, 2010. <http://calguns.net/calgunforum/showthread.php?t=259201>.

Calguns.net forum thread entitled "Why epoxy magazine blocks". p. 2. Jan. 14, 2010. <http://calguns.net/calgunforum/showthread.php?t=259201&page=2>.

AR15.com forum thread by user "fletchnuts" titled Turn a 20 Round PMAG into a 5 Round Hunting Mag (w/PICS!!!!), Apr. 4, 2009, http://www.ar15.com/forums/t_3_17/426869_DIY_MOD_Turn_a_20_Round_PMAG_into_a_5_Round_Hunting_Mag_w_PICS_.html.

Shotgunworld orum thread by user "Seamus O'Caiside" titled "Disassembly of Baretta 391", Feb. 26, 2007 http://www.shotgunworld.com/bbs/viewtopic.php?t=101242.

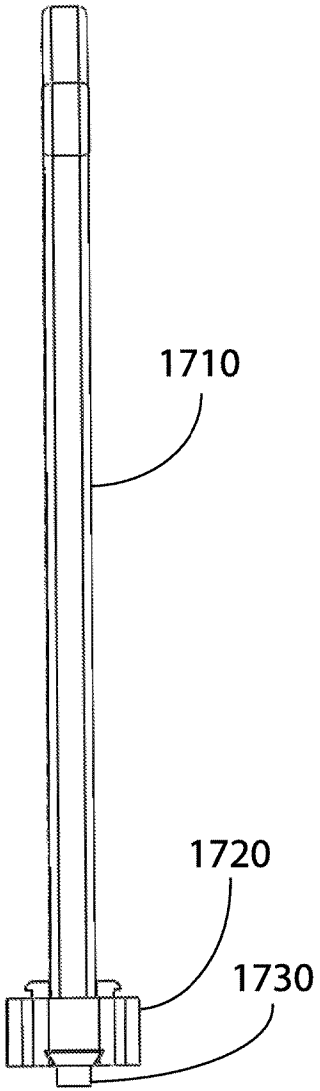
FIG. 17C
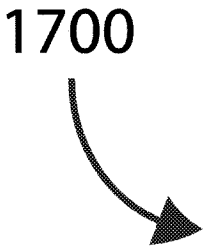

UNIVERSAL SYSTEMS AND METHODS FOR ADJUSTABLY LIMITING CAPACITY OF FIREARM MAGAZINES

CROSS REFERENCE TO RELATED APPLICATIONS

This non-provisional and continuation-in-part application claims the benefit of U.S. Provisional Application No. 62/448,946 filed on Jan. 20, 2017, pending, which application is incorporated herein in its entirety by this reference.

This application also is a continuation-in-part application and claims the benefit of U.S. application Ser. No. 15/344,898 filed on Nov. 7, 2016, pending, which application claims the priority and is a continuation of U.S. application Ser. No. 14/700,059 filed Apr. 29, 2015, now U.S. Pat. No. 9,488,426, issued on Nov. 8, 2016, which claims the priority and is a continuation-in-part of U.S. application Ser. No. 13/429,301 filed Mar. 23, 2012, now U.S. Pat. No. 9,328,982, issued on May 3, 2016, which claims the priority of U.S. Provisional Application No. 61/468,072 filed on Mar. 28, 2011, expired, which all applications are incorporated herein in their entirety by this reference.

BACKGROUND

To achieve the foregoing and in accordance with the present invention, systems and methods for limiting firearm ammunition capacity are provided. In particular, the systems and methods limit the cartridge capacity of detachable firearm magazines without compromising reliability.

Firearms and firearm accessories have steadily evolved over time, resulting in increased functionality and flexibility over time. Today, there is a variety of firearm modifications and/or accessories commercially available to accommodate a wide range of users' needs. Occasionally, innovation in the firearms industry is also driven by legislative trends, as firearm owners are required to respond by limiting the functionality of their firearms and/or accessories, for example, limiting the ammunition capacity of semi-automatic firearm magazines.

In response to political pressures, Federal and State laws have been enacted to limit features of semi-automatic firearms and also the capacity of firearm magazines. For example, in some jurisdictions, the use of detachable magazines with semi-automatic rifles is strictly regulated. To comply, detachable magazines sold in those jurisdictions must either be designed to or be altered to only accept a limited number of cartridges, e.g. ten rounds.

Prior inferior attempts at limiting magazine capacity include installing a rivet in the side of the magazine to limit the downward travel of the follower. This involves exterior modification of the magazine body and involves substantial trial and error to find the correct position of said rivet. Another prior method involves installing a large block under the bottom of the magazine spring and substantially filling up the bottom space of the magazine body. This method is not desirable because the installation of the block increases spring tension and wear. Alternatively, different magazine bodies can be retrofitted with different replacement springs, but that fails to provide a more generic solution.

Other attempts include modifications to the magazine followers, which is not desirable because the magazine follower is a critical component of the magazine and directly affects the magazine's reliability and functionality. For example, many magazine followers include anti-tilt features to increase magazine reliability and prevent malfunctions, and modifications to these followers are likely to adversely affect the magazine reliability.

In some of the more restrictive jurisdictions, magazine limiting modifications have to be considered "permanent" to be considered fully compliant legally. A common practice is to epoxy or roll pin the magazine body permanently closed. However, such drastic modifications do not allow the magazines to be reconfigured back to their original "higher capacity" configuration when used in other more liberal jurisdictions where these restrictions do not exist.

It is therefore apparent that an urgent need exists for improved cost-effective capacity-limiting assemblies for cost-effectively modifying higher-capacity magazines to comply with applicable laws and regulations, as needed, without compromising reliability. These improved capacity-limiting assemblies should enable users to quickly and efficiently limit the capacity of the magazines.

SUMMARY

To achieve the foregoing and in accordance with the present invention, systems and methods for limiting firearm ammunition capacity are provided. In particular, these systems and methods limit the cartridge capacity of detachable firearm magazines without adversely affecting reliability.

In one embodiment, a magazine capacity limiting assembly is configured to limit the cartridge capacity of a firearm magazine having a magazine body, a cartridge follower, a magazine spring and a magazine floor plate. This limiting assembly includes a magazine capacity limiter body and a magazine capacity limiter base. The magazine capacity limiter body includes a top edge configured to operate with the cartridge follower. The limiter body is installed substantially within coils of a magazine spring, thereby limiting the travel of the magazine follower within the magazine body to limit the magazine's cartridge capacity. The magazine capacity limiter base is operatively coupled to both the magazine limiter body and the magazine floor plate.

The lower portion of the limiter body includes a plurality of extensions is configured to be severed at a corresponding plurality of pre-determined locations corresponding to a plurality of cartridge capacities. The limiter may include a cupped top configured to be securely coupled the cartridge follower of a corresponding type of firearm.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which:

FIGS. 2A and 2B are side views illustrating two alternate configurations of one embodiment of a magazine capacity limiting assembly in accordance with the present invention, while

FIGS. 17A-17D illustrate another embodiment of an interchangeable adjustable capacity limiting assembly in accordance with the present invention;

FIG. 25A depicts the limiter of FIG. 24 mounted under a cartridge follower, while

DETAILED DESCRIPTION

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

Aspects, features and advantages of exemplary embodiments of the present invention will become better understood with regard to the following description in connection with the accompanying drawing(s). It should be apparent to those skilled in the art that the described embodiments of the present invention provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto. Hence, use of absolute and/or sequential terms, such as, for example, "will," "will not," "shall," "shall not," "must," "must not," "first," "initially," "next," "subsequently," "before," "after," "lastly," and "finally," are not meant to limit the scope of the present invention as the embodiments disclosed herein are merely exemplary.

Figure 1:
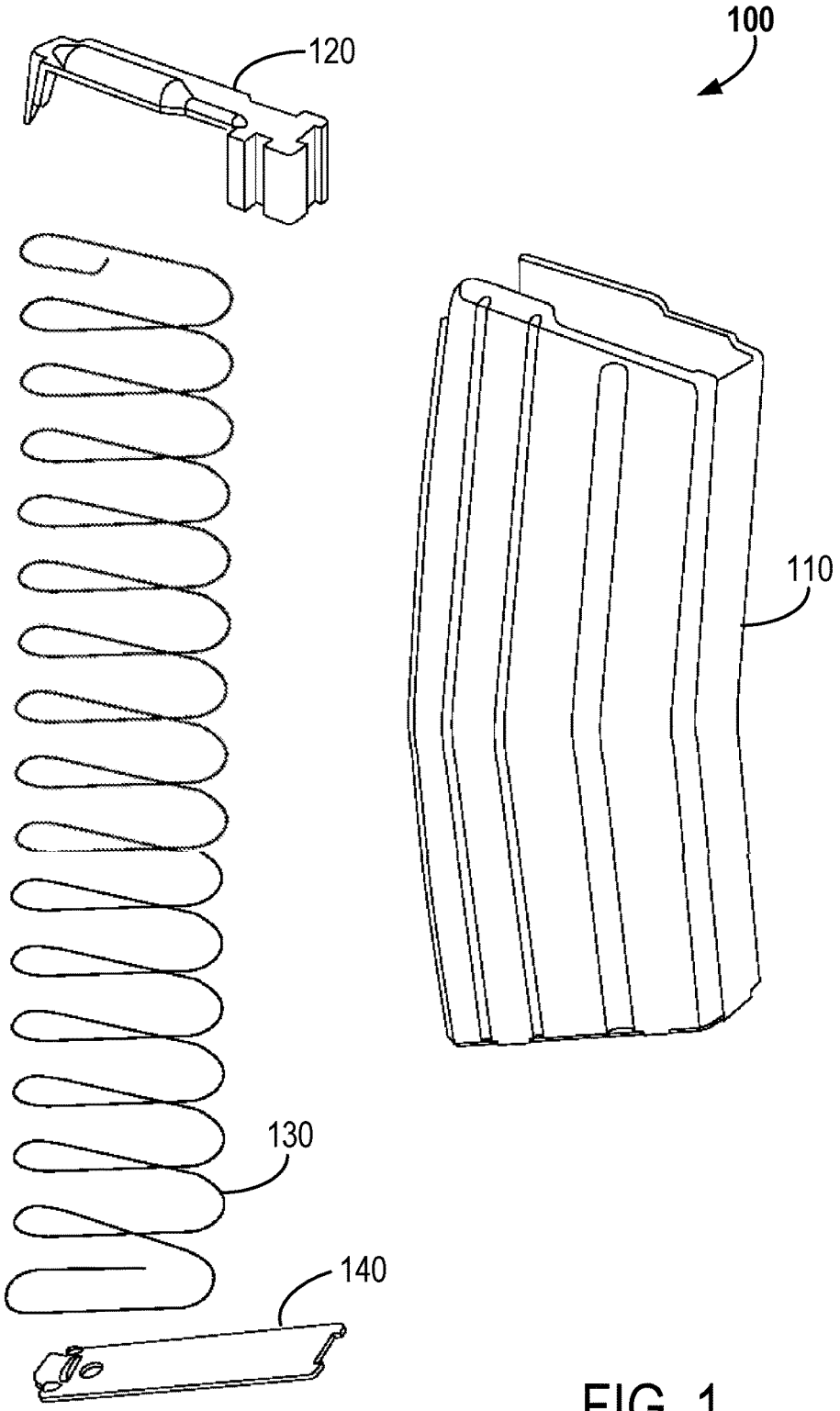
FIG. 1 is an exploded view showing the components of an exemplary high-capacity firearm magazine.

The present invention relates to systems and methods for limiting firearm ammunition capacity are provided. In particular, the systems and methods for limiting the cartridge capacity of detachable firearm magazines. Referring first to FIG. 1, an exploded view of an exemplary detachable high-capacity ("high-cap") firearm magazine, magazine 100 includes a magazine body 110, a magazine follower 120, a magazine spring 130 and a magazine floor plate 140. Assembly of high-cap magazine 100 is accomplished by first inserting the top of the magazine follower 120 into the bottom the magazine body 110. Next, the magazine spring 130 is inserted from the bottom of the magazine body 110 and in contact with the bottom of the magazine follower 120. The magazine spring 130 is then compressed to be flushed with the bottom edge of the magazine body 110. The magazine floor plate 140 can now secured to the bottom of the magazine body 110, thereby completing the assembly process for high-cap magazine 100.

Figure 2A:
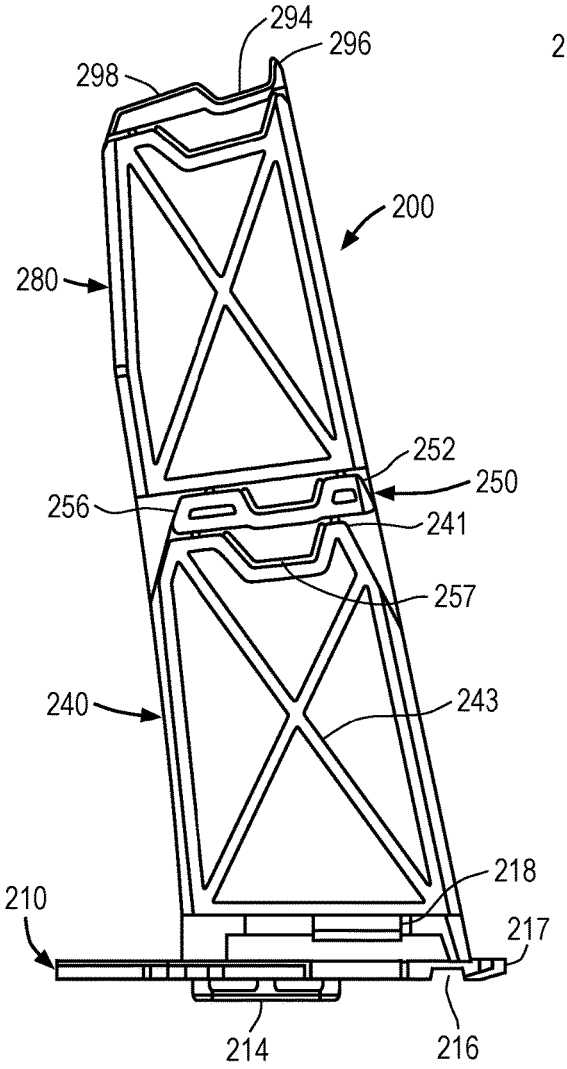
Figure 2C:
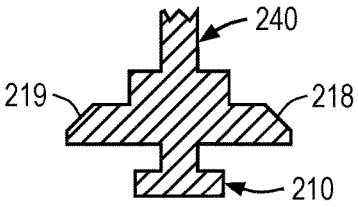
FIG. 2C is a partial cross-sectional view 2C-2C of the limiting assembly of FIG. 2B.
Figure 2B:
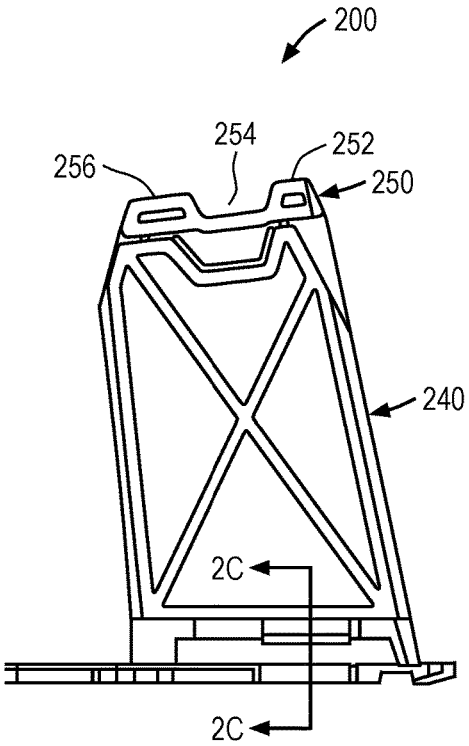

To facilitate discussion, FIGS. 2A and 2B show side views illustrating alternate configurations of one embodiment of a magazine capacity limiting assembly 200 in accordance with the present invention. FIG. 2C is a partial cross-sectional view 2C-2C of the lower portion of limiter assembly 200. Assembly 200 can be configured and incorporated into high-cap magazines, e.g., high-cap magazine 100, thereby limiting the number of firearm cartridges, e.g., ten cartridges, which can be loaded into these magazines.

As shown in FIG. 2A, capacity limiting assembly 200 includes a magazine locking plate 210, a lower limiter 240, an intermediate limiter 250, and an upper limiter 280. In this embodiment, an optional floor plate lock 214 may be operatively coupled to the locking plate 210. Optional floor plate lock 214 is intended to be compatible with aftermarket magazine floor plates having a corresponding mating recess such as Magpul™ "Ranger" and "L" floor plates, available from Magpul Industries Corporation, Boulder, Colo.

The locking plate 210 may include indentation(s) 216 enabling locking plate 210 to be retained by a floor plate attached to the magazine 100 and enabling the locking plate 210 to sit flush against the bottom of the magazine 100. In addition, the magazine spring 130 can be retained and held in place by a spring lock 218 and a corresponding spring lock 219 protruding outwards from opposite sides of lower limiter 240. Protruding spring locks 218, 219 may be chamfered to allow downward movement of the bottom of the magazine spring 130 to engage the lock 218 during installation, but prevent the spring 130 from easily or unintentionally being detached from lower limiter 240. A recess in the upper surface 294 engages a spring attachment point of the magazine follower 120. Upon completion of installation, the downward force of the spring 130 secures the bottom of spring 130 to limiter 240. One or more optional snap locks (not shown) may also be added to further secure the bottom of the magazine spring 130 to limiter 240. Alternatively, instead of spring locks 218, 219, one or more holes may be drilled in lower limiter 240 to accept and secure the bottom of magazine spring 130. Additionally, adhesives such as epoxy can also be used to permanently secure spring 130 to limiter 240.

Note that alternative upper surfaces 241, 252/256, 298 of limiters 240, 250, 280, respectively, are molded into the limiter assembly 200. Accordingly, the overall height of limiting assembly 200 can be reduced by severing at these predetermined locations, thereby varying the cartridge capacity of magazine 100 as needed, as illustrated by the alternate configuration shown in FIG. 2B.

Capacity limiting assembly 200 can include reinforcement structures, e.g., cross rib 243, to increase structural integrity and reduce weight and material used for manufacturing. Furthermore, reinforcement structures 257, 256 are designed so that they can be easily removed when the limiting assembly 200 is reconfigured into, for example, the alternate configuration of FIG. 2B.

Figure 3:
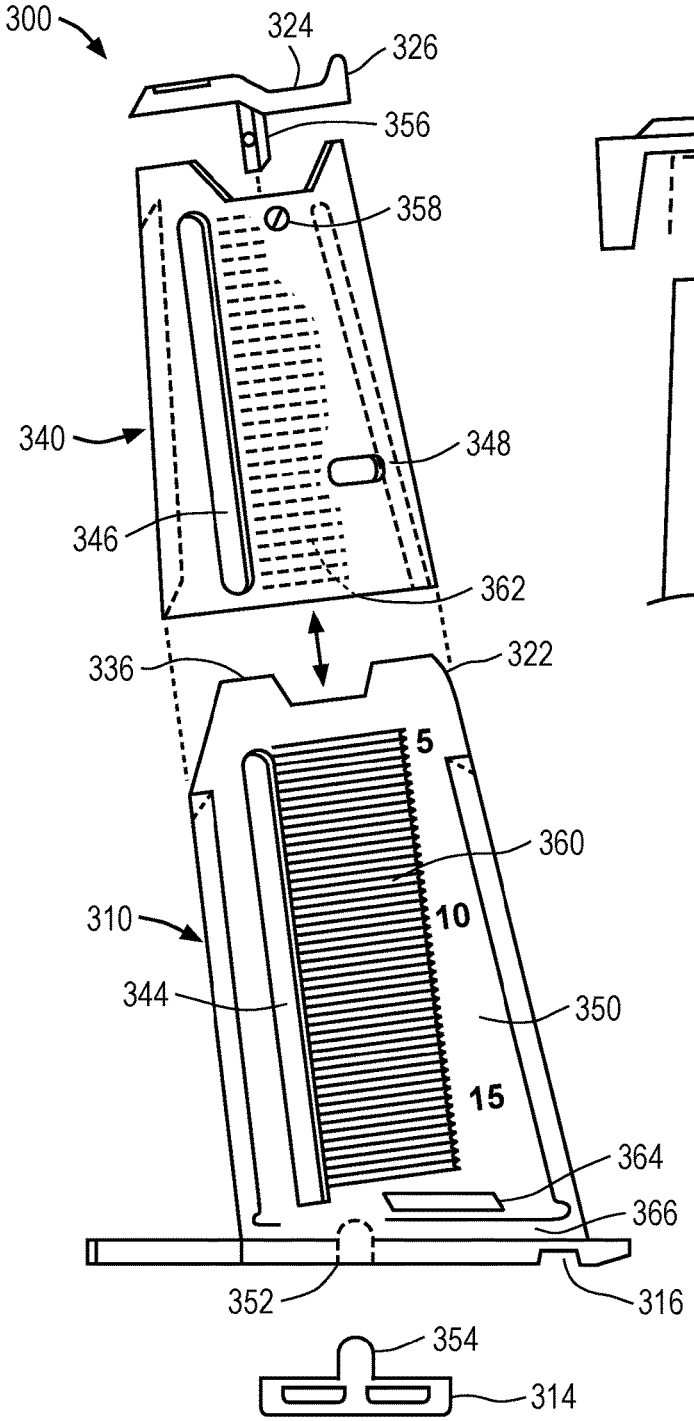
FIG. 3 is a side view of another embodiment of a magazine capacity limiting assembly.
Figure 4:
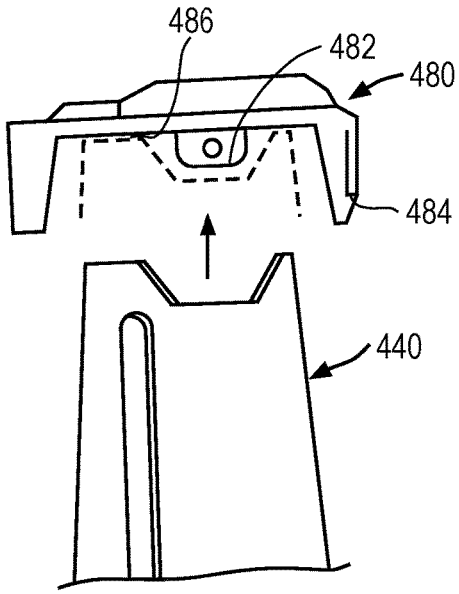
FIG. 4 illustrates the operation of the top of the magazine capacity limiting assemblies in relation to a magazine follower of a firearm magazine.

FIGS. 3 and 4 illustrate another embodiment of a limiting assembly 300 in which the height of an upper limiter 340 can be varied in relation to a lower limiter 310, thereby changing the overall height of limiting assembly 300. This can be accomplishes by use of adjustment slots 344, 346 of limiters 310, 340, respectively, and a screw and nut (not shown). A ribbed surface 360 on a face of lower limiter 310 is configured to be operatively engaged to a matching ribbed surface 362 on a corresponding face of the upper limiter 340.

A window 348 of upper limiter 340 display markings 350 allowing easy adjustments to predetermined magazine cartridge capacity settings of limiting assembly 300. These capacity settings are intended to correspond with different magazine variants and/or cartridge capacities.

Depending on specific configuration of the magazine followers, e.g. magazine follower 120 or 480, the upper mating surface 326 can be removed and replaced with a variety of alternative attachments via, for example, a post 356 secured to upper limiter 340 by a fastener such as a set screw 358. As shown in FIG. 4, such an arrangement also permits adaptations of lateral positioning of the upper surface recess 294 which is necessary for the different lower mating surfaces 486 of the magazine follower 480 and its spring attachment point 482.

Similarly, as discussed above for limiting assembly 200, to increase adaptability of limiting assembly 300 to a wide variety of magazine floor plates, alternative floor plate locks 314 can be added or removed via, for example, a post 354 and socket 352 arrangement.

Figure 5:
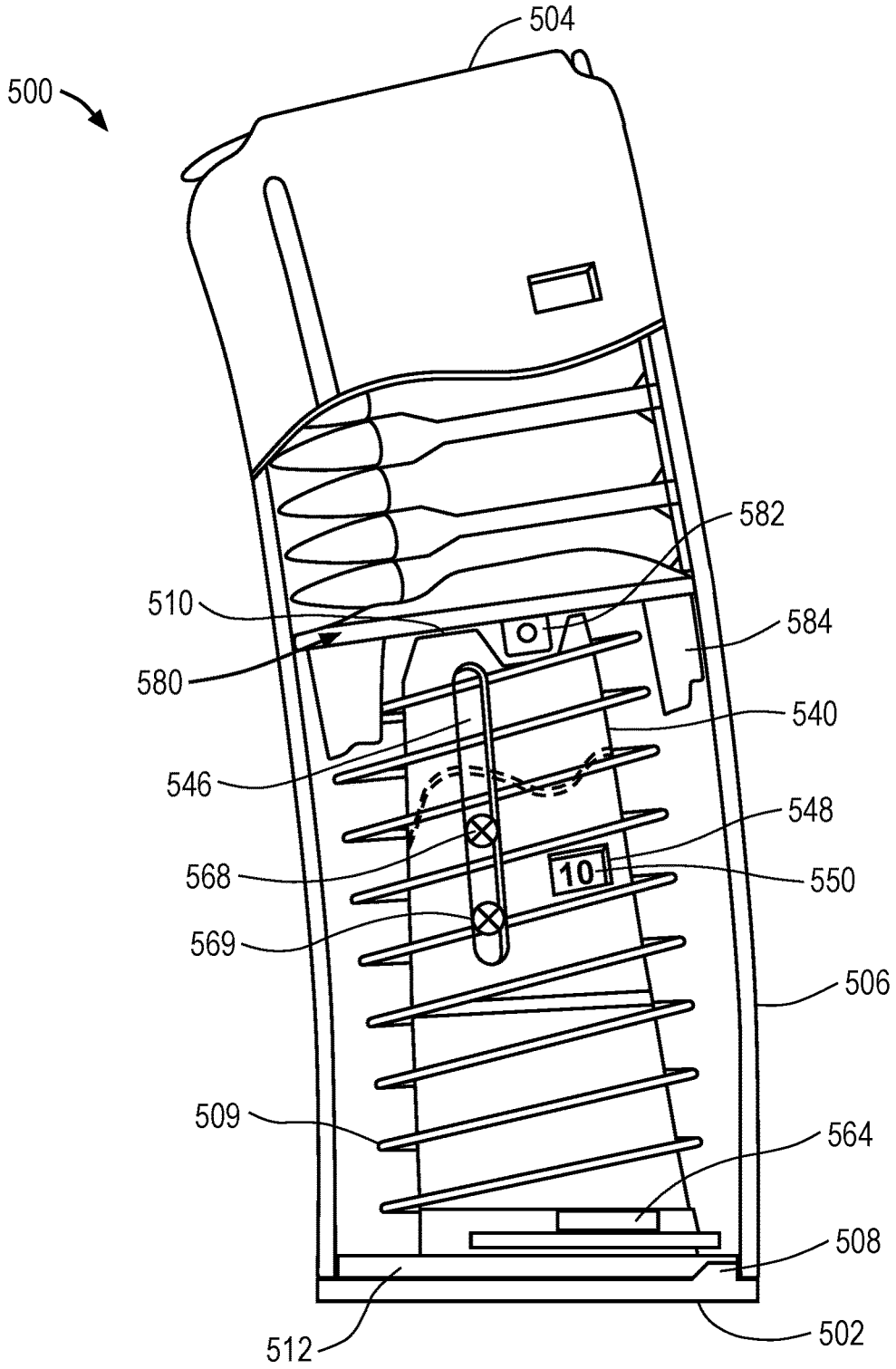
FIG. 5 is a perspective view illustrating a magazine, partially sectioned, with a magazine capacity limiting assembly of the present invention installed.

Referring now to FIG. 5, a cut-away view, one embodiment of an exemplary cartridge magazine 500 is loaded with a plurality of bottle-nose cartridges, e.g., a 5.56 mm cartridge magazine. Note that in this embodiment, configurable capacity limiting assembly 300 has been installed in magazine 500. Accordingly, the distance from the upper magazine lip surface 504 to the upper surface of the magazine follower 580, corresponding to the cartridge capacity of magazine 500, is limited now by assembly 300.

The limiting assembly 300 is configured to be installed within the coils of the magazine spring 509. The dimensions of the magazine walls 506 will determine the size and shape of the locking plate 512. The profile and size of the locking plate 210 may also be shaped to fit similar magazines without, or with minor modification(s). Further, a reliability-enhancing clearance gap 510 may be added to accommodate the loading of the rifle with a closed bolt or action and/or with dust covers. This clearance gap 510 is large enough to allow downward travel of the magazine follower 580 for these functions, but not large enough to permit an additional unwanted cartridge to be loaded into magazine 500.

The locking plate 512 is configured to be installed flush against the magazine floor plate 502 and to engage locking indentations 508 of the floor plate 502. The magazine spring 509 is attached to the upper magazine follower 580 at its intended attachment point 582 and also under the locking lug 564 of assembly 300. A permanent attachment may be made between limiting assembly 300 and magazine 500 to comply with applicable laws, regulations and ordinances, which may specify that a "permanent" alteration of the magazine 500 is required. As illustrated by FIG. 5, the upper limiter 540 may include a profile necessary to allow clearance of the downward protrusions 584 of the lower surfaces of magazine follower 580. The adjustment slot 346 is shown locked in place by the set screw(s) 568 at a position corresponding to, for example, ten cartridges or five cartridges (per hunting regulations), as seen through the magazine capacity window 548.

Figure 6:
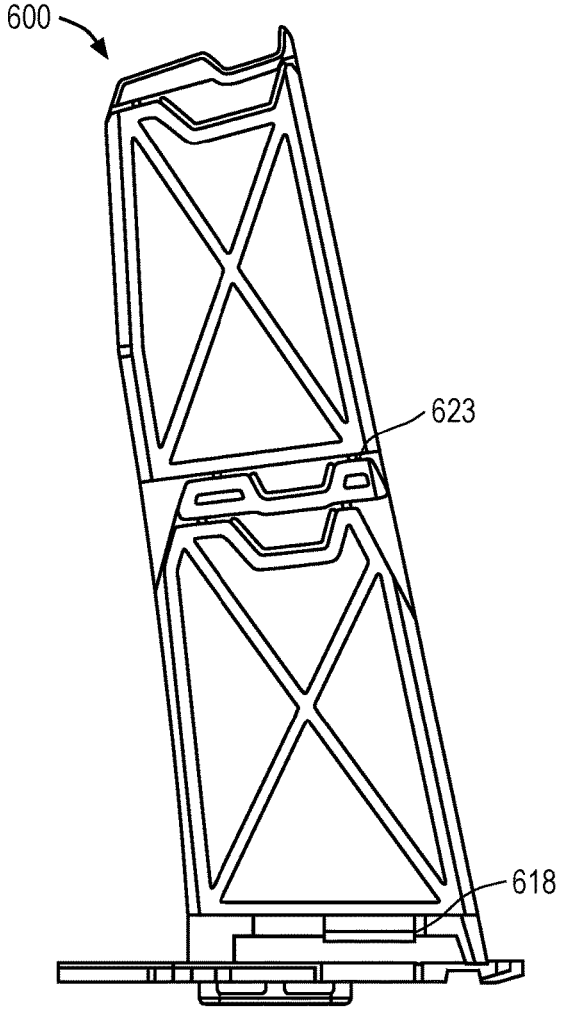
FIGS. 6 and 7 illustrate two alternate embodiments of a magazine capacity limiting assembly.
Figure 7:
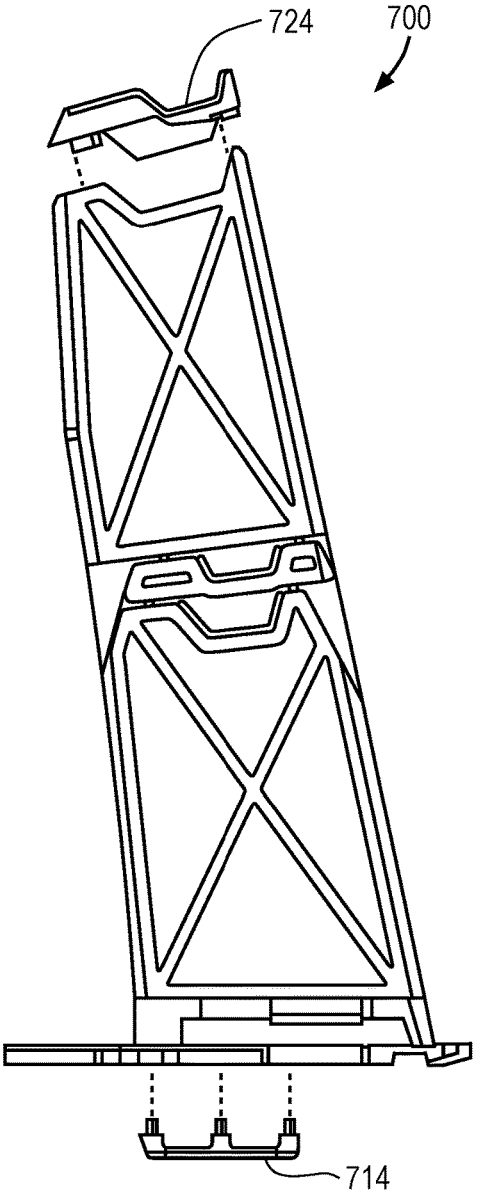

Many modifications and enhancements to the described embodiments are also possible. For example, the side view of FIG. 6 shows structural support rib(s) 623 bracing the area through which a cut can be made to easily and reliably configure an alternate configuration. These support structure(s) provide flexural strength, while enabling ease of configuring predetermined sizes. In addition, FIG. 7 illustrates an alternate method of changing the upper recess 724 location, and the removal of the locking plate lock 714.

Figure 8:
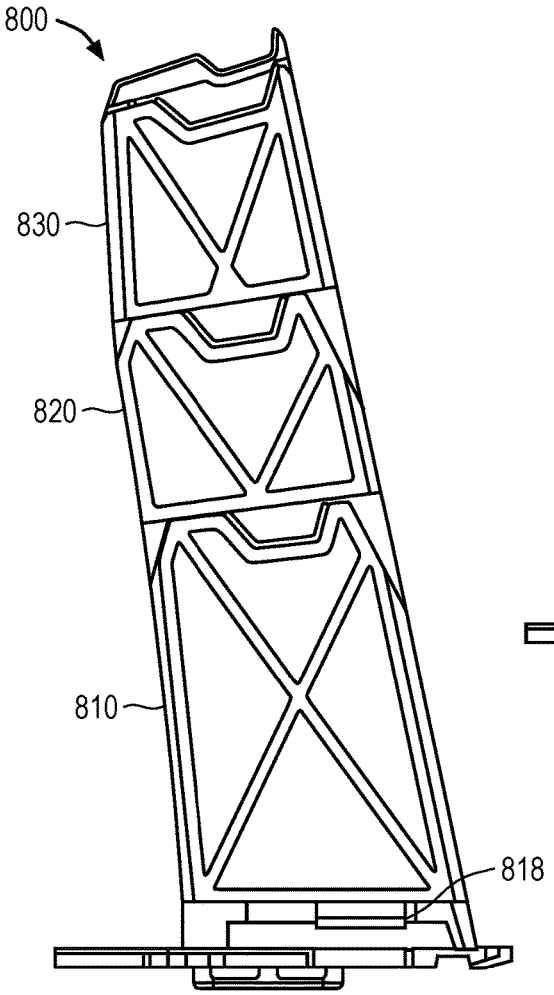
FIG. 8 is a side view of another embodiment of a capacity limiting assembly having an upper limiter, an intermediate limiter and a lower limiter.

FIG. 8 shows another embodiment of a capacity limiting assembly 800 having three stacked limiters 810, 820, 830 corresponding to three different overall heights from the bottom of limiter assembly 800. Accordingly, detaching the top limiter 830 from the lower limiter 810, or both the top and intermediate limiter 820, 830, from the lower limiter 810, introduces two additional configuration having two predetermined lower cartridge capacities for the same magazine 100. Alternatively, the two additional shortened configurations of limiting assembly 810 can be installed in smaller magazines having shorter magazine bodies (not shown).

Figure 9:
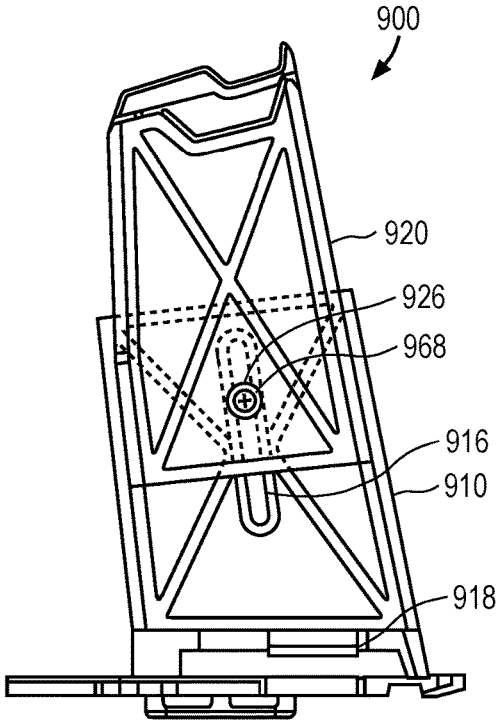
FIG. 9 illustrates yet another embodiment of a capacity limiting assembly having detachable lower and upper limiters, and wherein the overall height of the limiting assembly is adjustable.

FIG. 9 illustrates yet another embodiment of an adjustable capacity limiting assembly 900 wherein the lower and upper limiters 910, 920 include a slot 916 and a hole 926, respectively, configured to accommodate a fastener such as a machine screw 968. In this embodiment, it is possible for lower and upper limiters 910, 920 of limiting assembly 900 to be initially formed as one contiguous structure, with the bottom of the upper limiter 920 joined to the top of lower limiter 910, in a configuration similar to that limiting assembly 200.

Figure 10A:
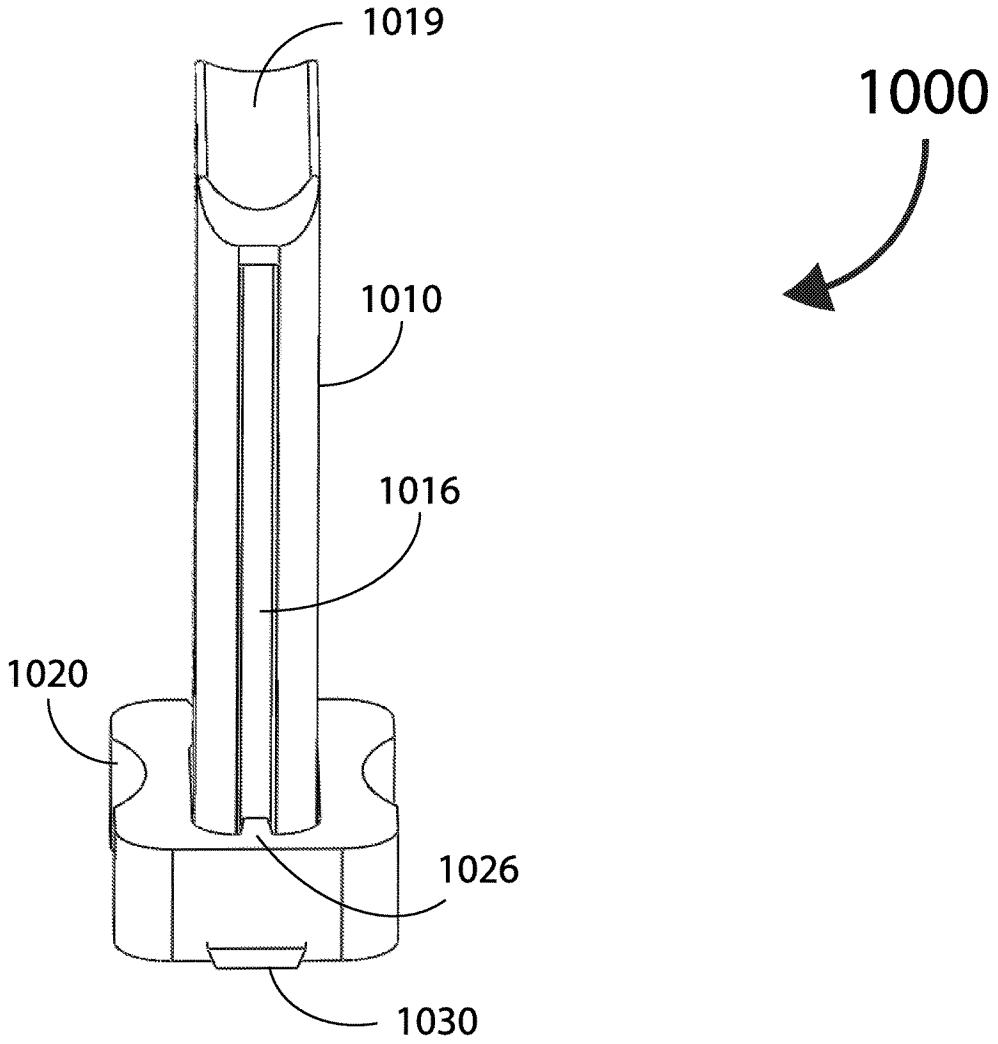
FIGS. 10A and 10B illustrate one embodiment of an interchangeable adjustable capacity limiting assembly in accordance with the present invention.
Figure 10B:
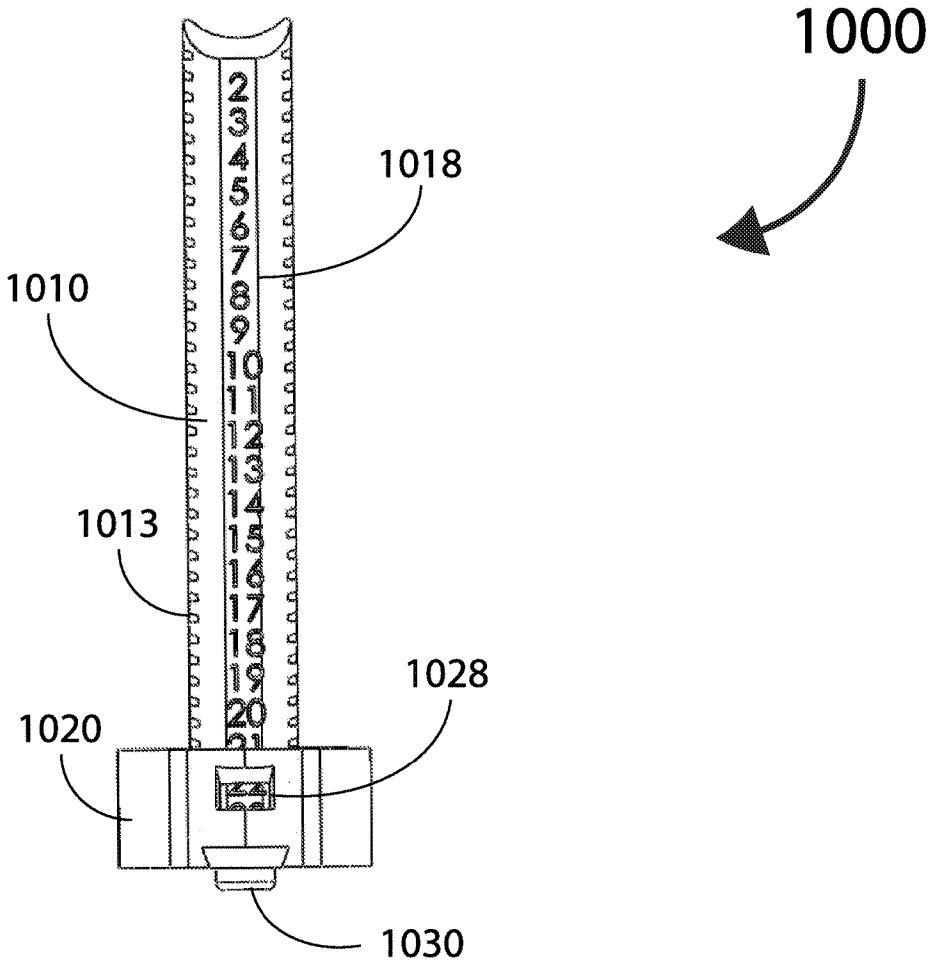
Figure 11A:
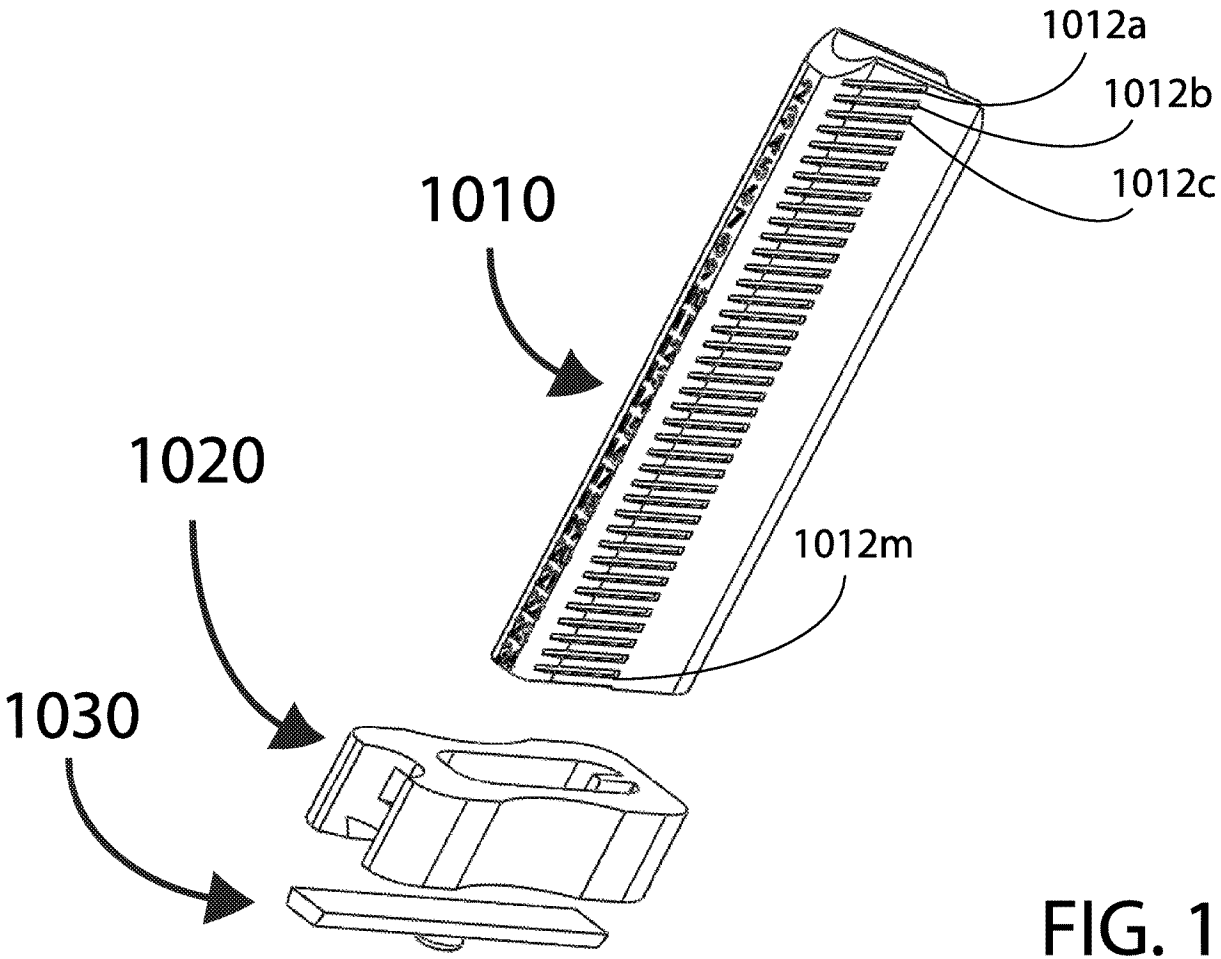
FIGS. 11A and 11B provide exploded views of the limiter body and limiter base of the limiter assembly of FIG. 10A.
Figure 11B:
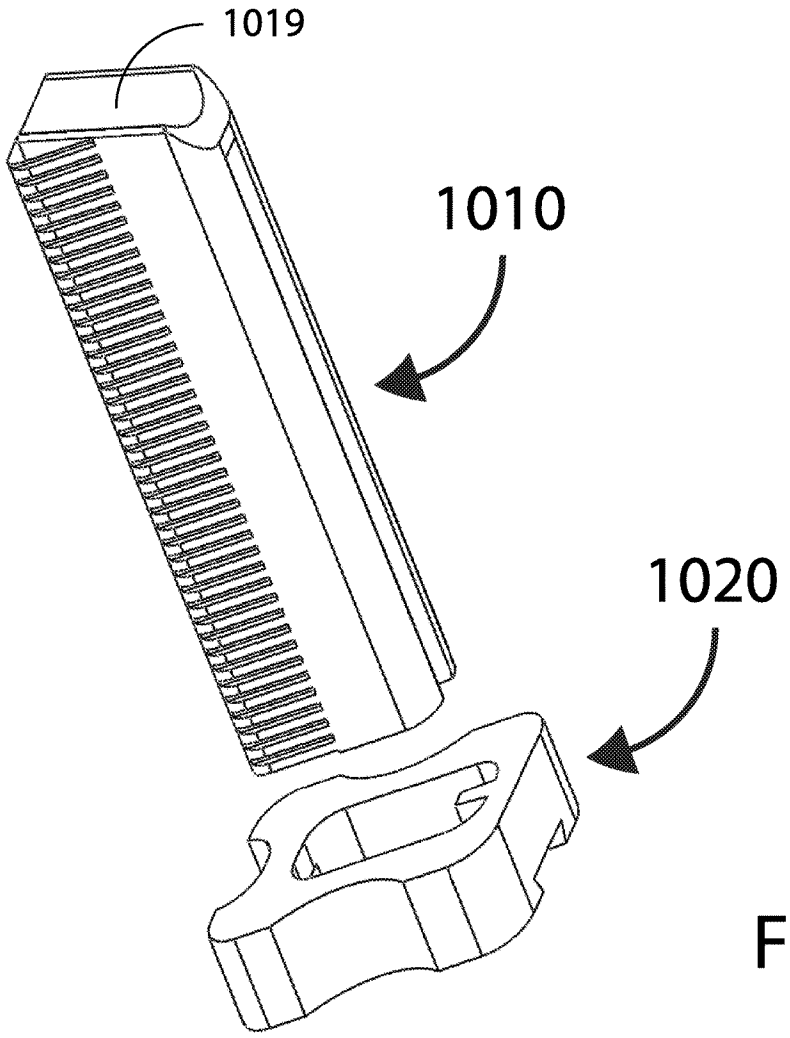
Figure 12A:
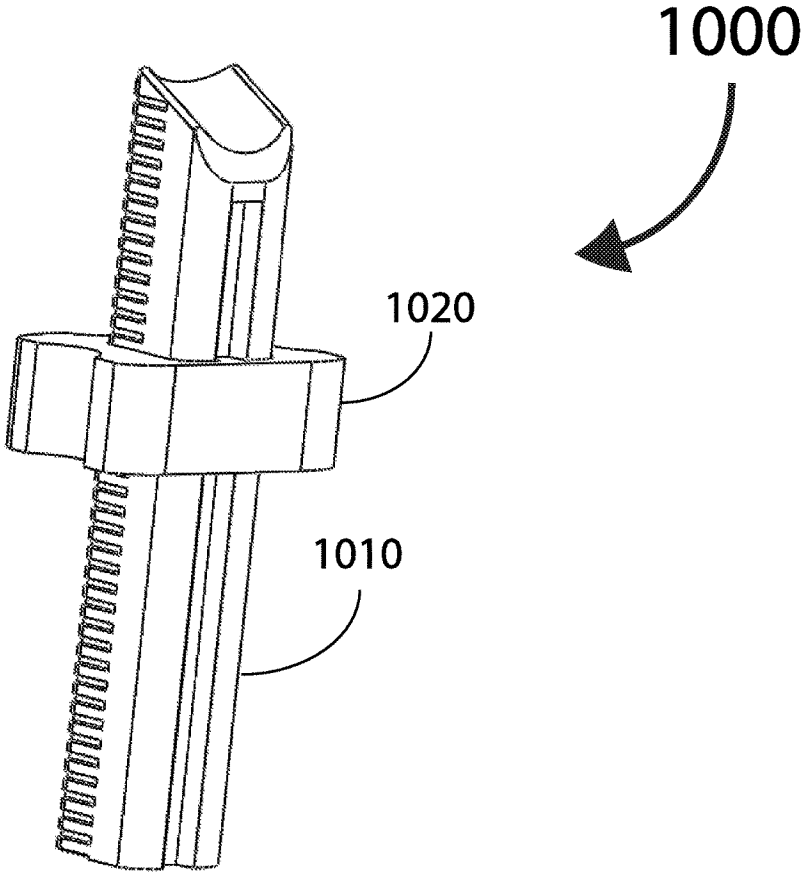
FIGS. 12A and 12B provide front and back views of a partially constructed limiter assembly of FIG. 10A.
Figure 12B:
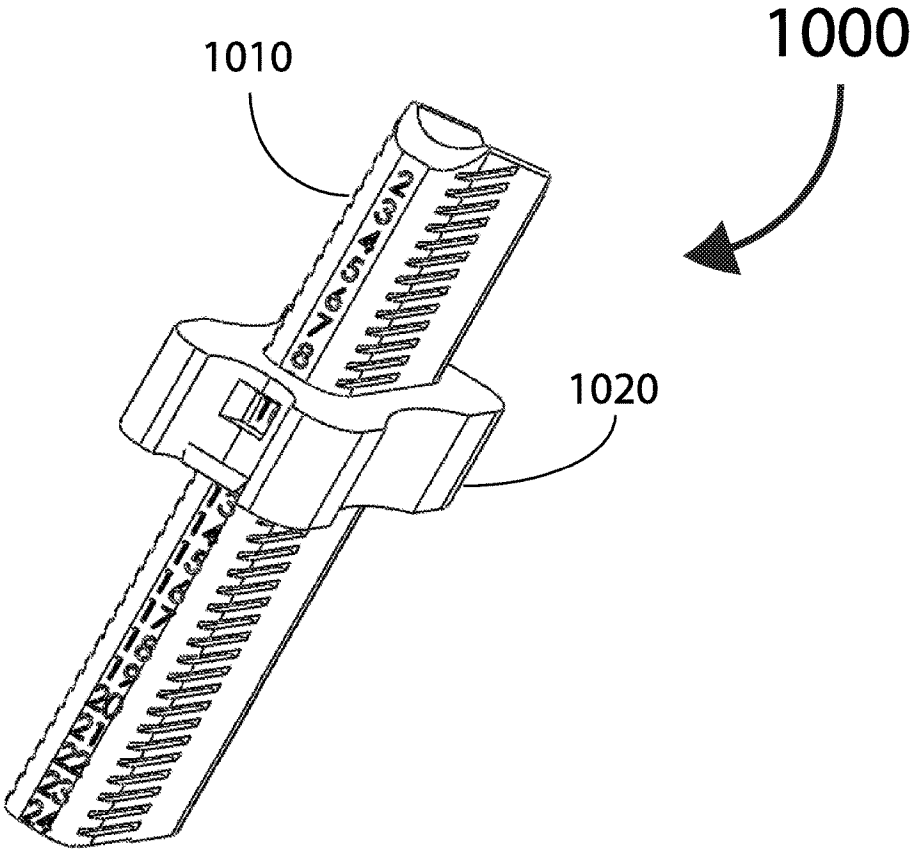
Figure 13:
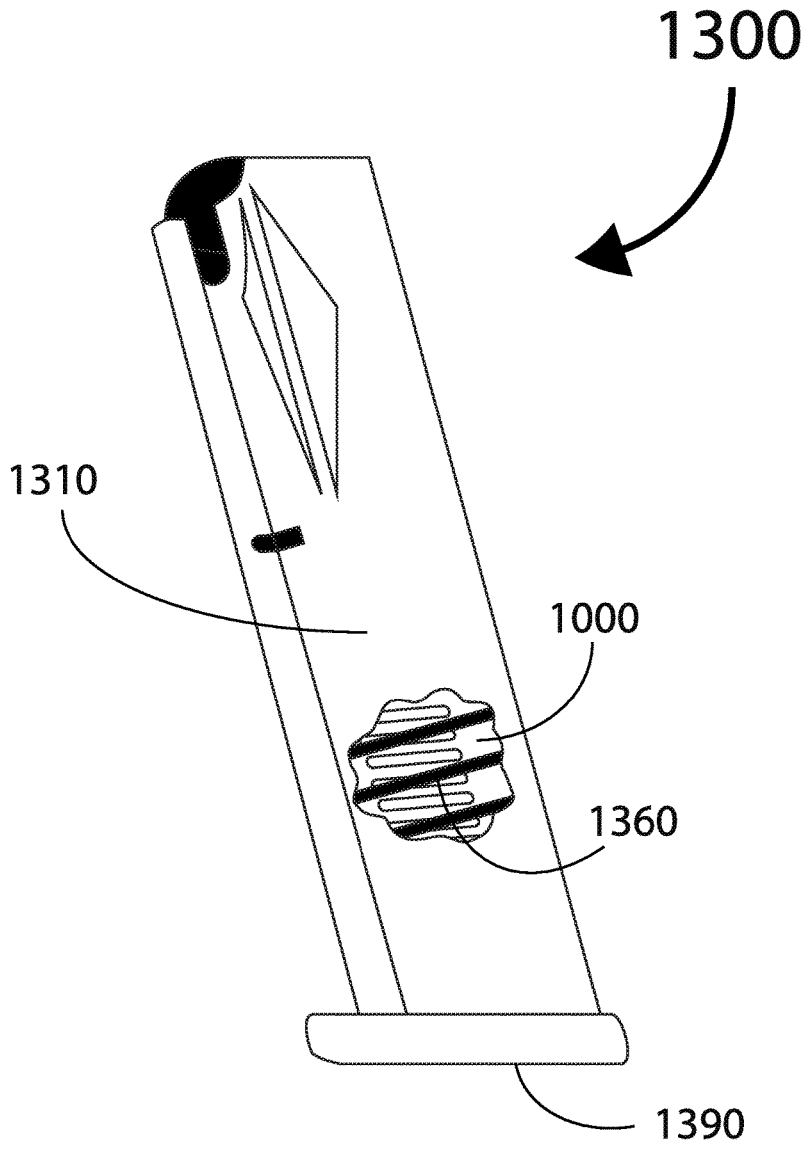
FIG. 13 shows a cutaway view of a typical pistol caliber magazine incorporating the limiter assembly of FIG. 10A.

FIGS. 10A and 10B are a perspective view and a front view of one embodiment of a universal interchangeable adjustable-capacity limiting assembly 1000 in accordance with the present invention. Limiting assembly 1000 includes an interchangeable limiter body 1010 and an interchangeable limiter base 1020. In some embodiments, assembly 1000 also includes an optional magazine base lock 1030. FIGS. 11A and 11B provide exploded views of limiter body 1010 and base 1020, while FIGS. 12A and 12B provide front and back views of partially constructed limiter assembly 1000, respectively. In addition, FIG. 13 shows a cutaway view of an exemplary pistol caliber magazine 1300 incorporating limiter assembly 1000.

Figure 14A:
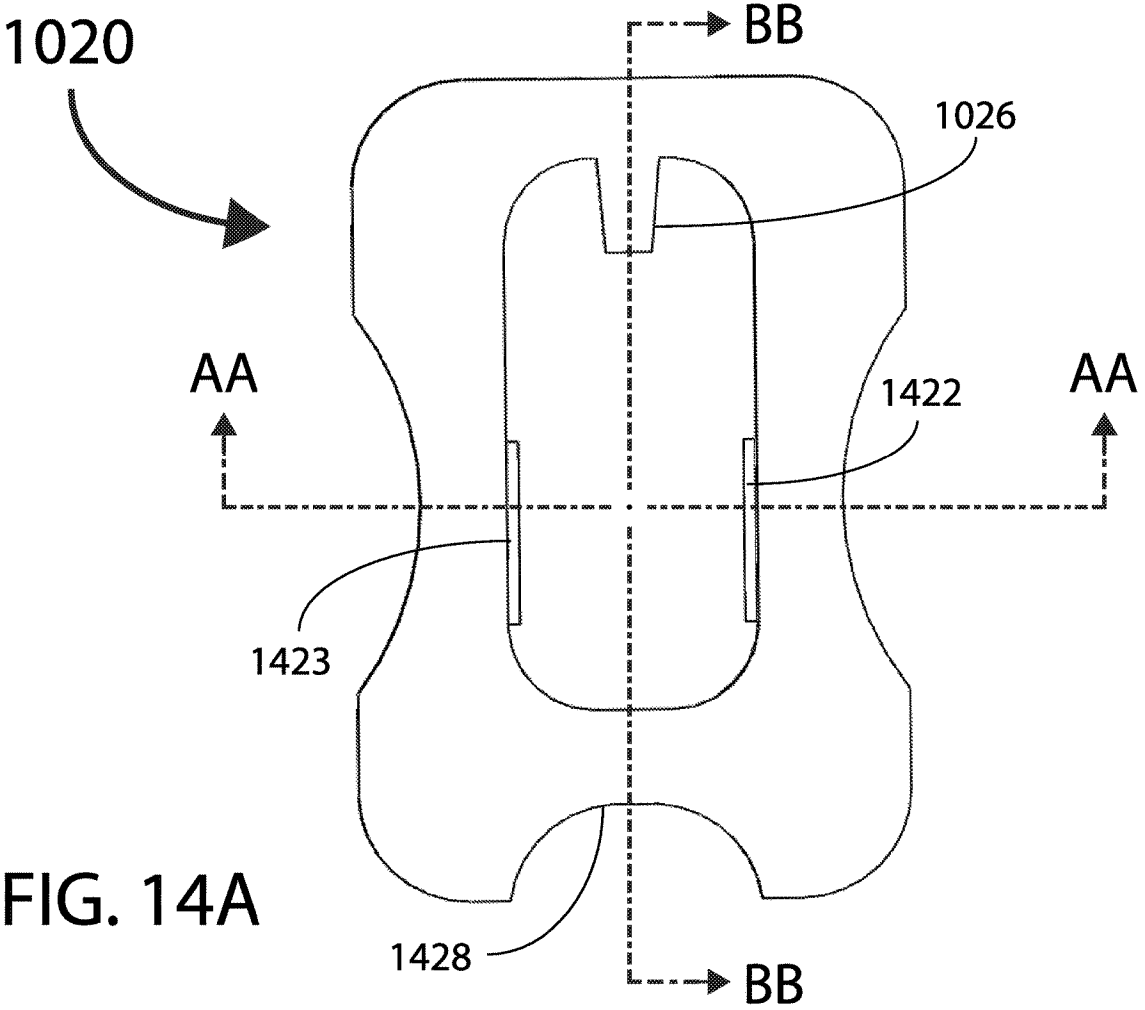
FIGS. 14A and 14B are bottom and perspective views of the limiter base of FIG. 10A.

In this embodiment as illustrated by the exploded view of FIG. 11A, limiter body 1010 includes at least one plurality of notches 1012*a*, 1012*b*, 1012*c* . . . 1012*m*. As shown in FIG. 14A, limiter base 1020 includes at least one corresponding capacity catch 1422 configured to securely engage with one of the plurality of notches 1012*a*, 1012*b*, 1012*c* . . . 1012*m* to "permanently" limit cartridge capacity of a firearms magazine, thereby enabling the user to comply with applicable Federal statute(s), State law(s), local ordinance(s) and/or sporting organization rule(s) mandating such firearm magazine capacity limit. Note that angular stability between limiter body 1010 and base 1020 is also enhanced when capacity catch 1422 is securely engaged with one of the plurality of notches 1012*a*, 1012*b*, 1012*c* . . . 1012*m*.

Referring to both FIGS. 10B and 14A, in some embodiments, limiter body 1010 also includes a second plurality of corresponding notches located on the opposing side 1013 of body 1010, which provides additional stability to limiter assembly 1000 when an appropriate one of these notches operatively coupled to catch 1423 of base 1020.

As shown in FIG. 10A, the back view of limiter assembly 1000, limiter body 1010 may include an optional vertical recessed track, i.e., groove 1016, configured to accommodate a corresponding optional guide rib 1026 of base 1020 thereby enhancing stability of limiter assembly 1000. Further, as shown in FIG. 10B, the front view of limiter assembly 1000, base 1020 includes an optional capacity window 1028 useful in combination with an optional capacity indicator stripe 1018 of limiter body 1010, enabling a user to easily select an appropriate cartridge capacity for firearms magazine 1300. Note that in some embodiments, indicator stripe 1028 can be configured to provide corresponding reference numbers instead of directly indicating the cartridge capacity.

Figure 14B:
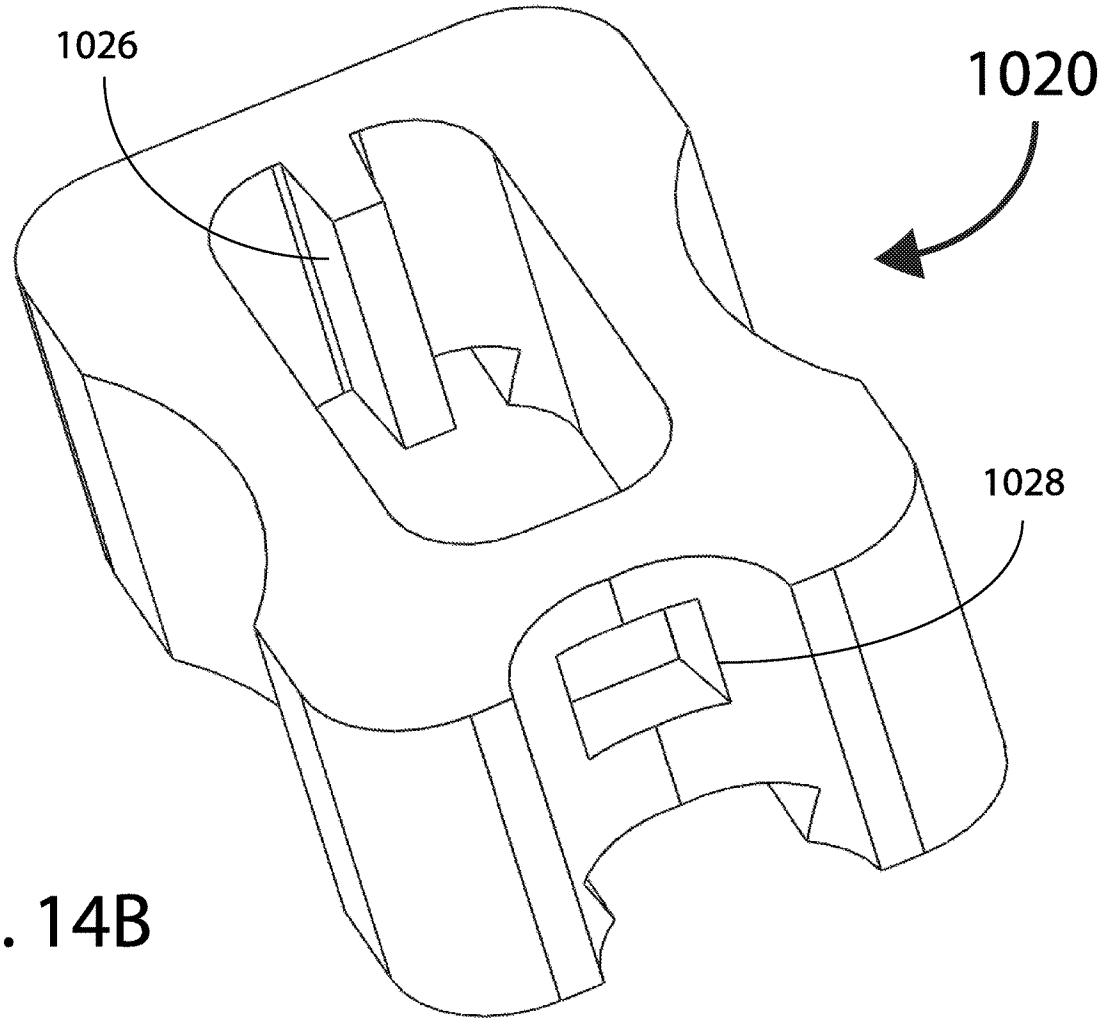
Figure 15A:
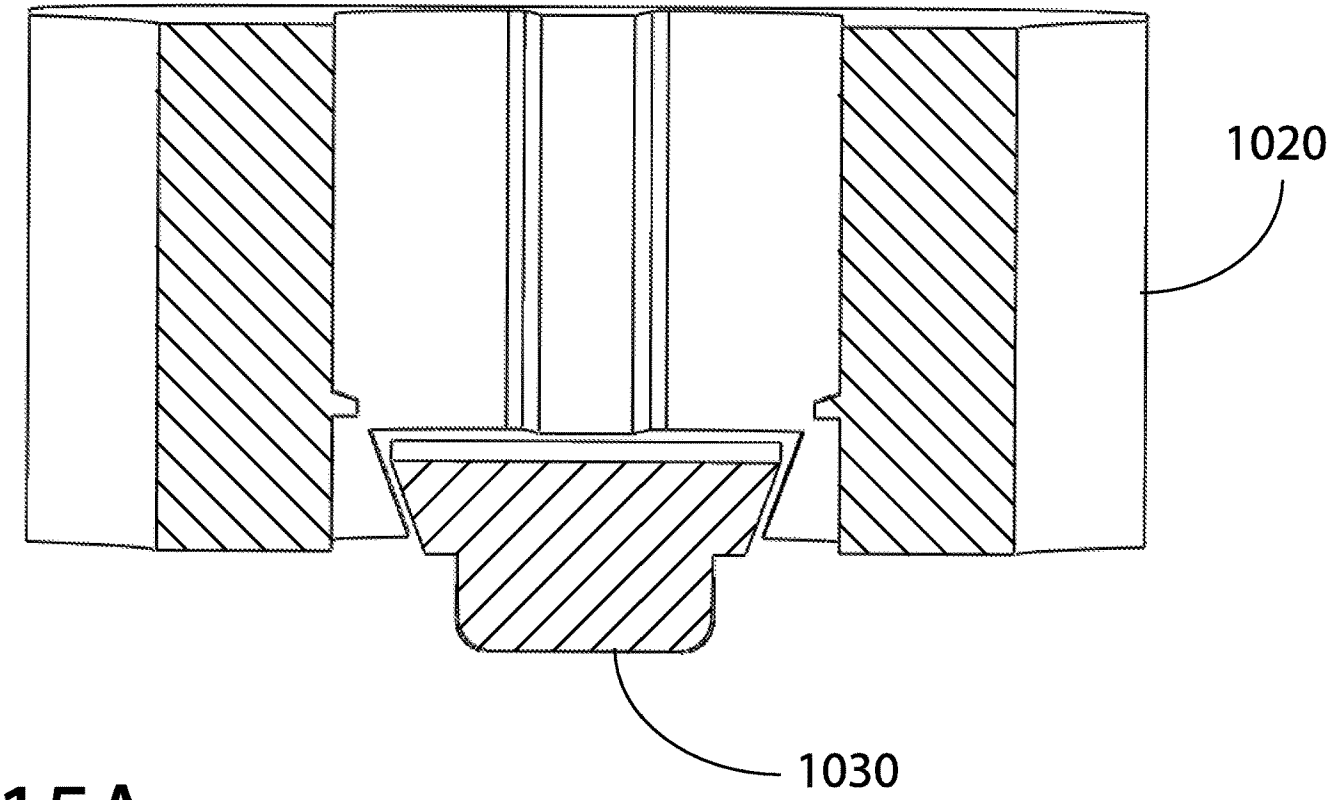
FIGS. 15A and 15B are cross-sectional views AA-AA and BB-BB of the limiter base of FIG. 10A.
Figure 15B:
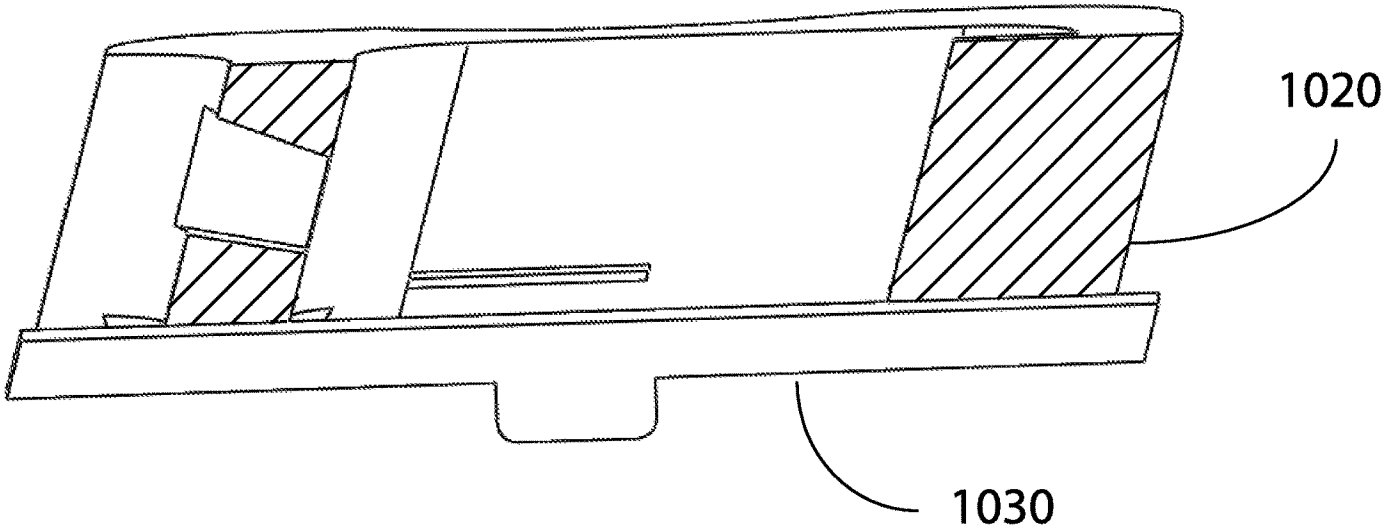

The above described features are also illustrated by FIGS. 14A and 14B, bottom and perspective views of limiter base 1020, and further illustrated by FIGS. 15A and 15B, cross-sectional views AA-AA and BB-BB of limiter base 1020, respectively.

Referring now to FIGS. 12A and 12B, cartridge capacity of firearms magazine 1300 using limiter assembly 1000 can be configured as follows. The user inserts limiter body 1010 into limiter base 1020, and then slides base 1020 along body 1010 while observing the capacity window 1028. When the appropriate cartridge capacity is reached, the user can use a sharp blade or a saw to severe a protruding end of limiter body 1010 while using the bottom surface of base 1020 as a guide.

Depending on the specific design of firearm magazine 1300, optional magazine base lock 1030 can then be inserted into a slot, e.g., a dovetail slot, located at the bottom of limiter base 1020. In some embodiments, magazine base lock 1030 includes a locking tab configured to protrude and engage a corresponding hole of magazine floor plate 1390. The location of this locking tab relative to limiter assembly 1000 can be easily adjusted by the user to fit a particular magazine by simply sliding the base lock 1030 within the slot of limiter base 1020. It is contemplated that a parts kit for limiter assembly 1000 can include one or more of a variety of interchangeable magazine base locks having locking tabs of different shapes, sizes and/or locations to adapt to a wide range of firearms magazines.

Conversely, instead of using the optional magazine base lock 1030, limiter base 1020 can be configured to be operatively coupled to an original magazine locking plate (not shown). As such, limiter base 1020 can also include an optional recess 1428 configured to provide clearance for a raised retainer of the original magazine locking plate, wherein the raised retainer is configured to couple the magazine spring to the original magazine locking plate.

As shown in FIG. 13, the limiter assembly 1000 can now be inserted within the spring coils 1360 of the magazine spring and into the body 1310 of firearms magazine 1300. Note that the top surface of limiter body is suitably profiled so the cartridge follower (hidden) of magazine 1300 rests securely on top of limiter body 1010 and does not slide off during operation as cartridges are added or removed.

The magazine floor plate 1390 can now be secured to the bottom of magazine body 1310, thereby completing the cartridge limiting process for magazine 1300.

Figure 16:
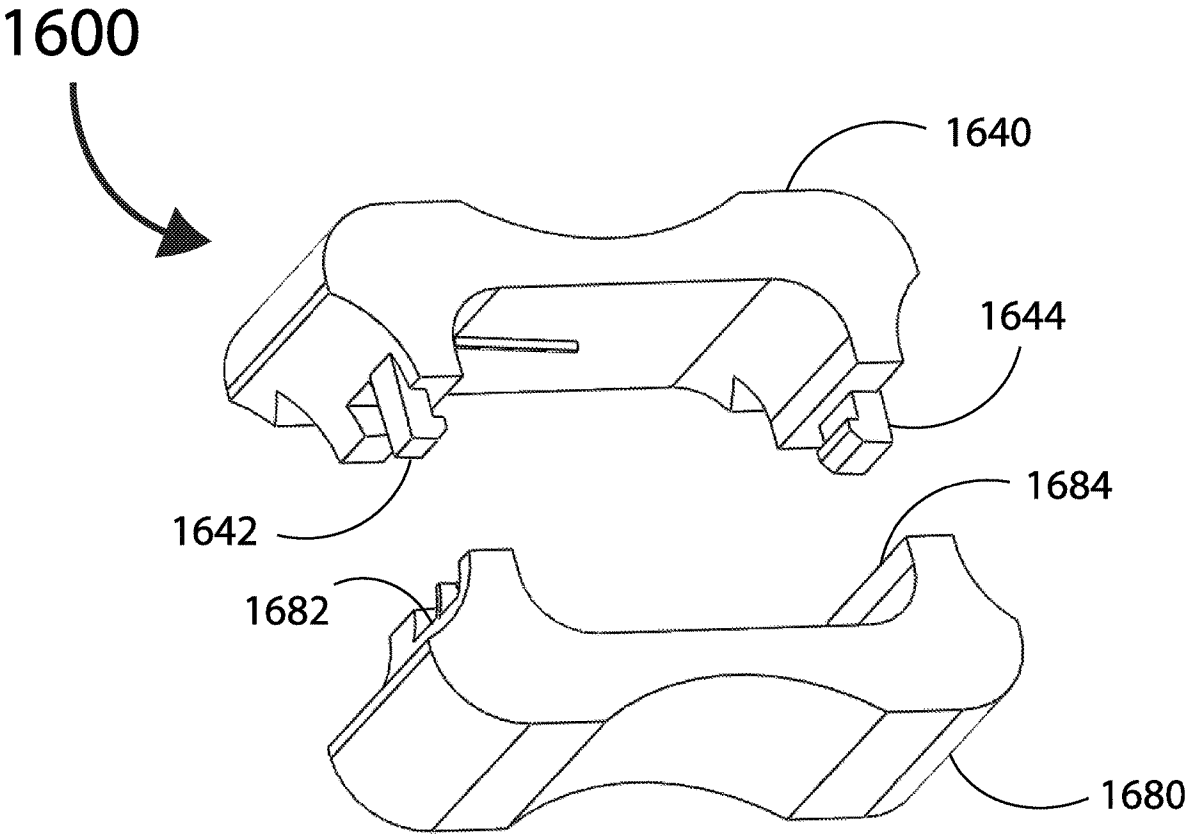
FIG. 16 is a perspective view of yet another embodiment of the limiter base for the limiter assembly of FIG. 10A.

Limiter body 1010 and/or base 1020 can be manufactured using a variety of suitable processes, including machining, 3D printing and plastic molding processes. Hence in yet another embodiment of limiter base 1600 (see FIG. 16), for ease of manufacturing and pre-assembly, base 1600 can be initially manufactured as two sub-components 1640, 1680, and configured to be coupled to each other, e.g., snapped together, via two mating latches 1642, 1682 and 1644, 1684. An optional feature of such a multi-component limiter base design is the ability to permanently capture the magazine spring.

Advantageous of universal interchangeable limiter assemblies of the present invention include interchangeability within a wide variety of cartridge calibers and/or brands/models of firearms, thereby reducing the number of stock parts to support a wide variety of firearms. For example, a 9 mm limiter body and a 40 S&W limiter body can be interchangeably coupled to a universal limiter base adapted for both full size and compact 9 mm and 40 S&W Glock™ or Sig Sauer™ pistol magazines. Hence by using the above described universal interchangeable and adjustable cartridge limiter assembly kit, a retailer and/or an end user can now use expeditiously assemble a suitable limiter body and base combination to accommodate a newly-released, custom and/or aftermarket firearms magazine.

FIGS. 17A, 17B, 17C and 17D are a perspective view, a side view, a front view and a top view, respectively, of another embodiment of a universal interchangeable adjustable-capacity limiting assembly 1700 in accordance with the present invention. Limiting assembly 1700 includes an interchangeable limiter body 1710 and an interchangeable limiter base 1720. In some embodiments, assembly 1700 also includes an optional magazine base lock 1730. FIG. 18 provides an exploded view of limiter assembly 1700 including limiter body 1710 and base 1720. In addition, FIG. 19 shows a cutaway view of an exemplary rifle caliber magazine 1900 incorporating limiter assembly 1700.

In this embodiment as illustrated by the exploded view of FIG. 18, limiter body 1710 includes at least one plurality of notches 1712*a*, 1712*b*, 1712*c* . . . 1712*p*. Limiter base 1720 includes at least one corresponding capacity catch (hidden) configured to securely engage with one of the plurality of notches 1712*a*, 1712*b*, 1712*c* . . . 1712*p* to "permanently" limit cartridge capacity of a firearms magazine, thereby enabling the user to comply with applicable Federal statute(s), State law(s), local ordinance(s) and/or sporting organization rule(s) mandating such firearm magazine capacity limit. In some embodiments, limiter body 1710 also includes a second plurality of corresponding notches (hidden) located on an opposing side of limiter body 1710, which provides additional stability to limiter assembly 1700.

Figure 17A:
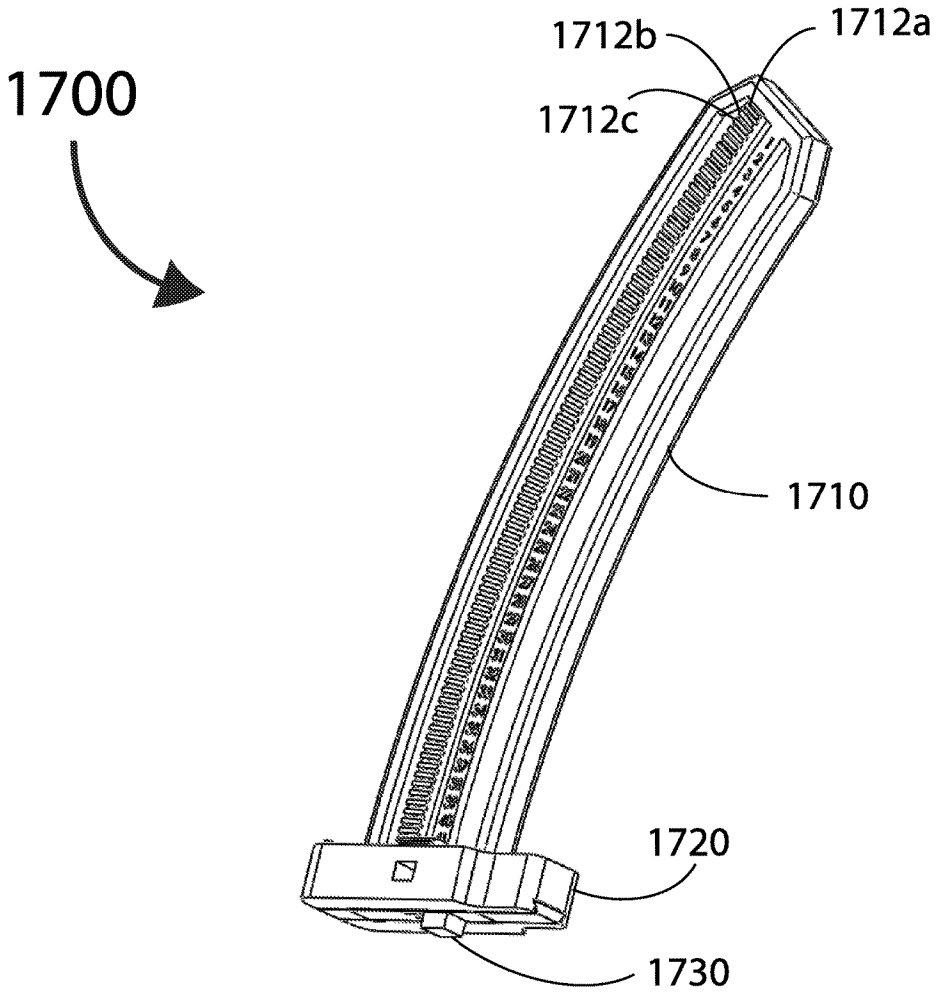
Figure 17B:
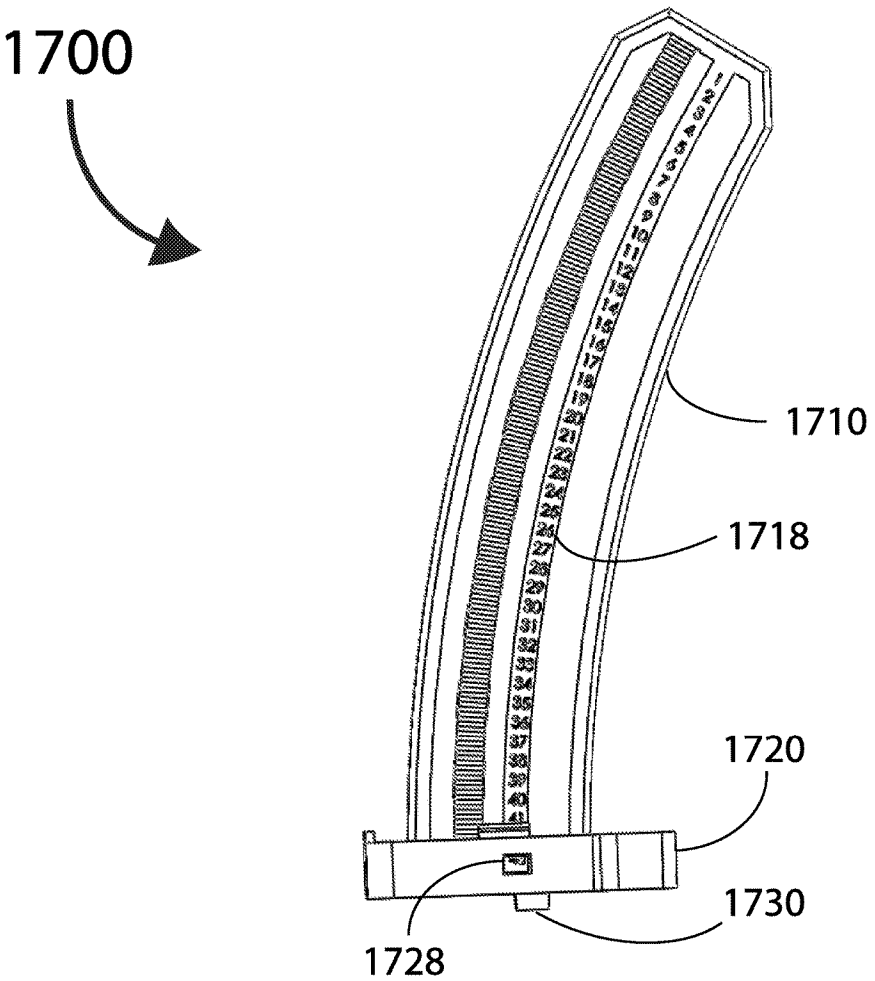
Figure 17D:
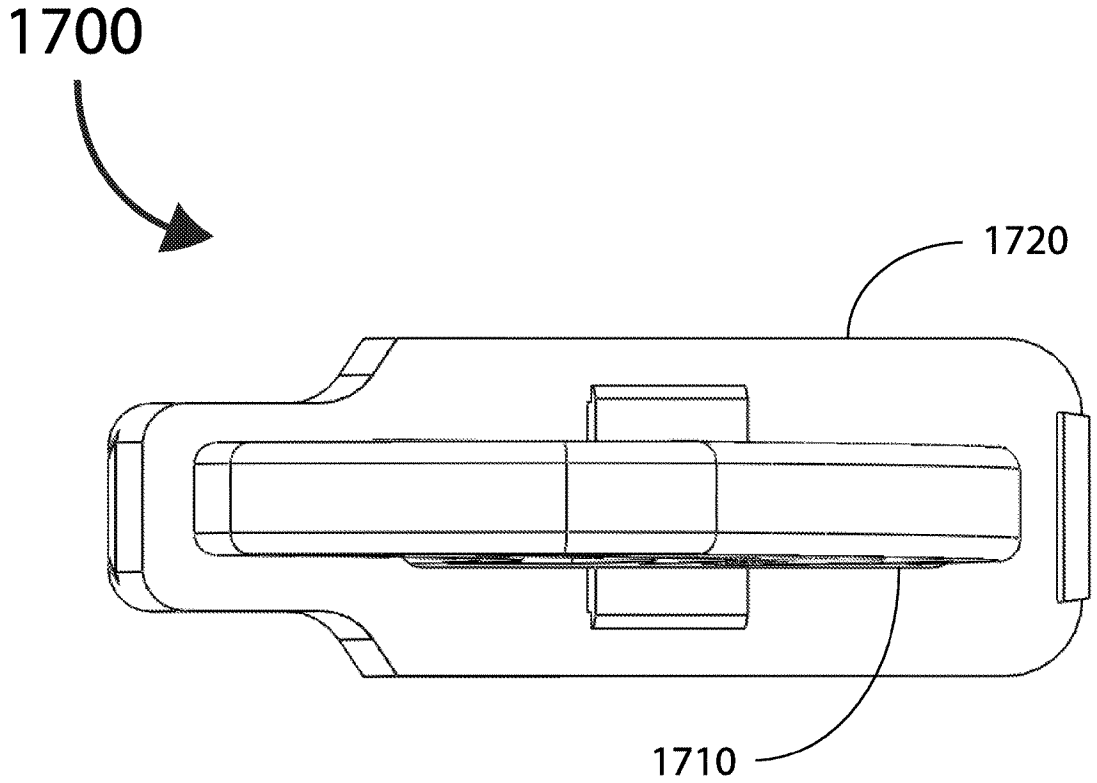
Figure 18:
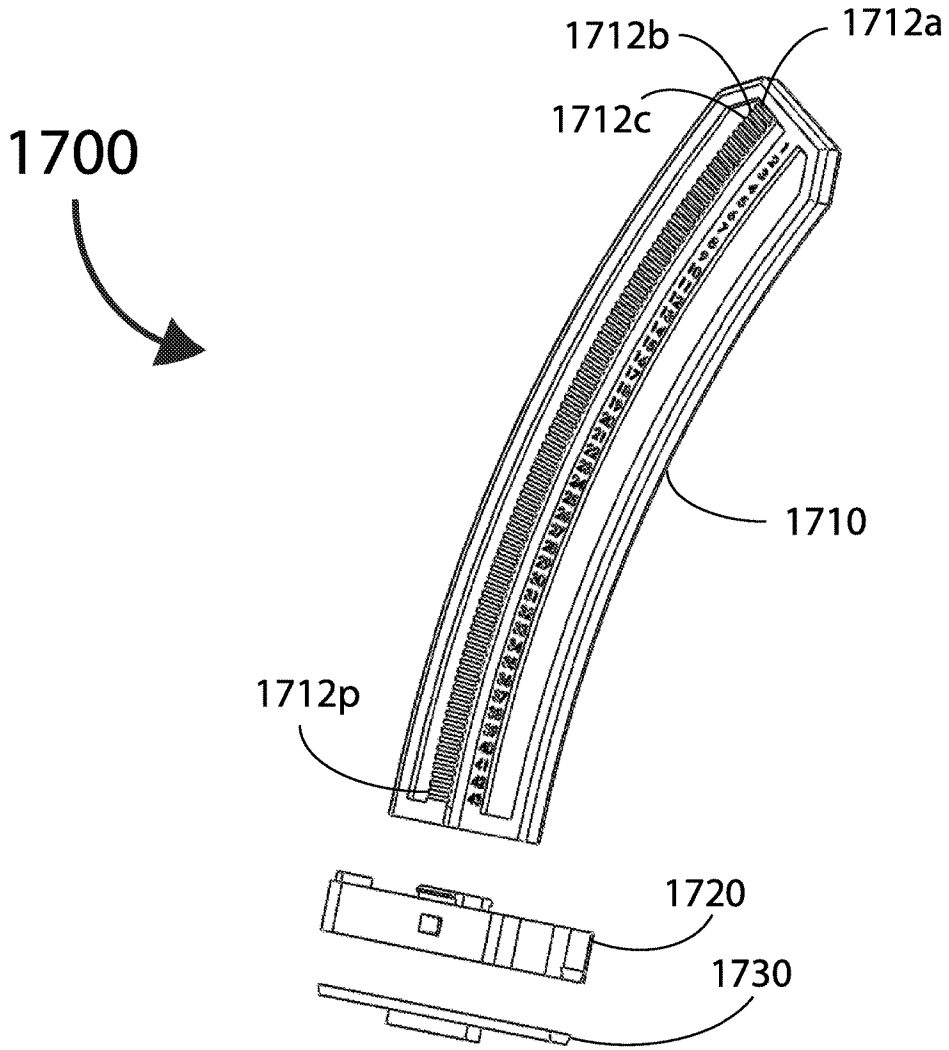
FIG. 18 provide an exploded view of the limiter body and limiter base of the limiter assembly of FIG. 17A.

In some embodiments, as shown in FIG. 17B, the side view of limiter assembly 1700, base 1720 includes an optional capacity window 1728 useful in combination with an optional capacity indicator stripe 1718 of limiter body 1710, enabling a user to easily select an appropriate cartridge capacity for firearms magazine 1900.

Figure 19:
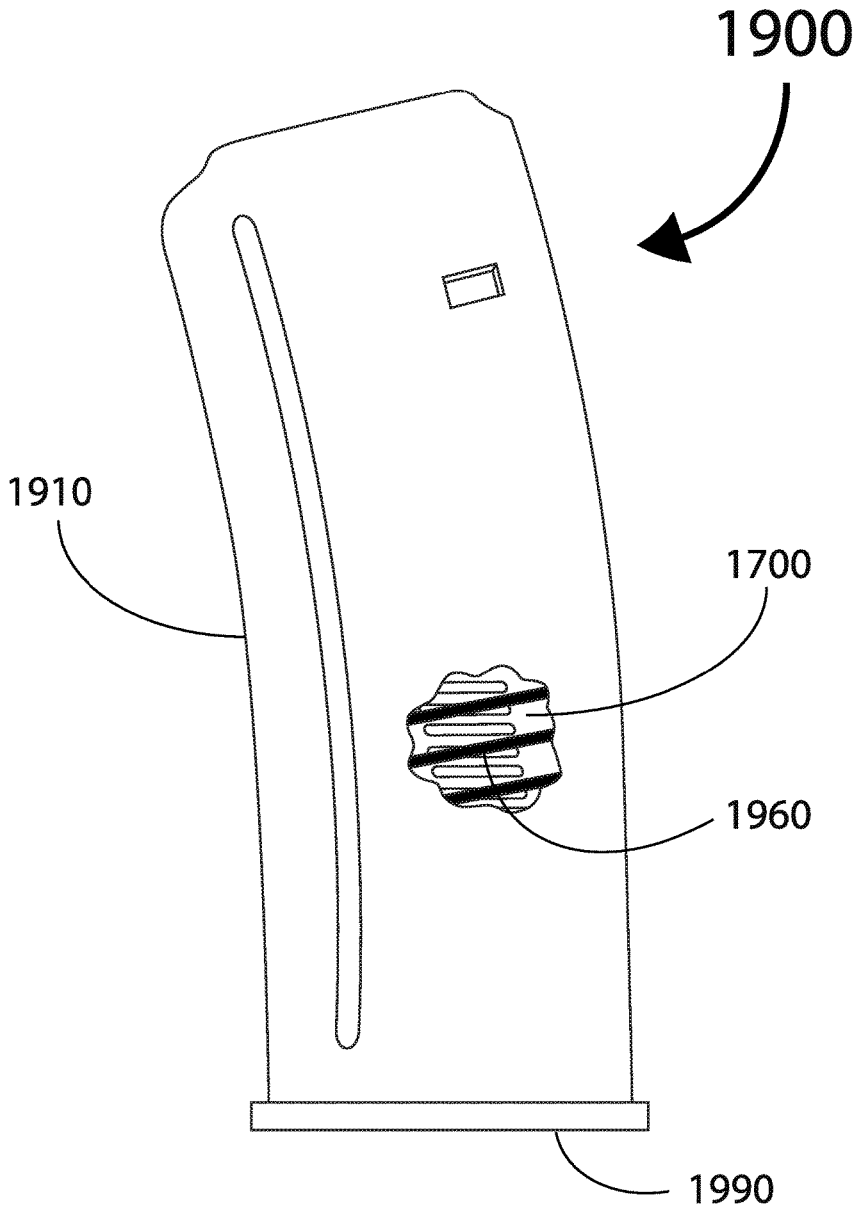
FIG. 19 shows a cutaway view of a typical rifle caliber magazine incorporating the limiter assembly of FIG. 17A.

As shown in FIG. 19, the limiter assembly 1700 can be inserted within the spring coils 1960 of the magazine spring and into the body 1910 of firearms magazine 1900. The magazine floor plate 1990 can be secured to the bottom of magazine body 1310, thereby appropriately limiting the cartridge capacity for magazine 1900.

Figure 20A:
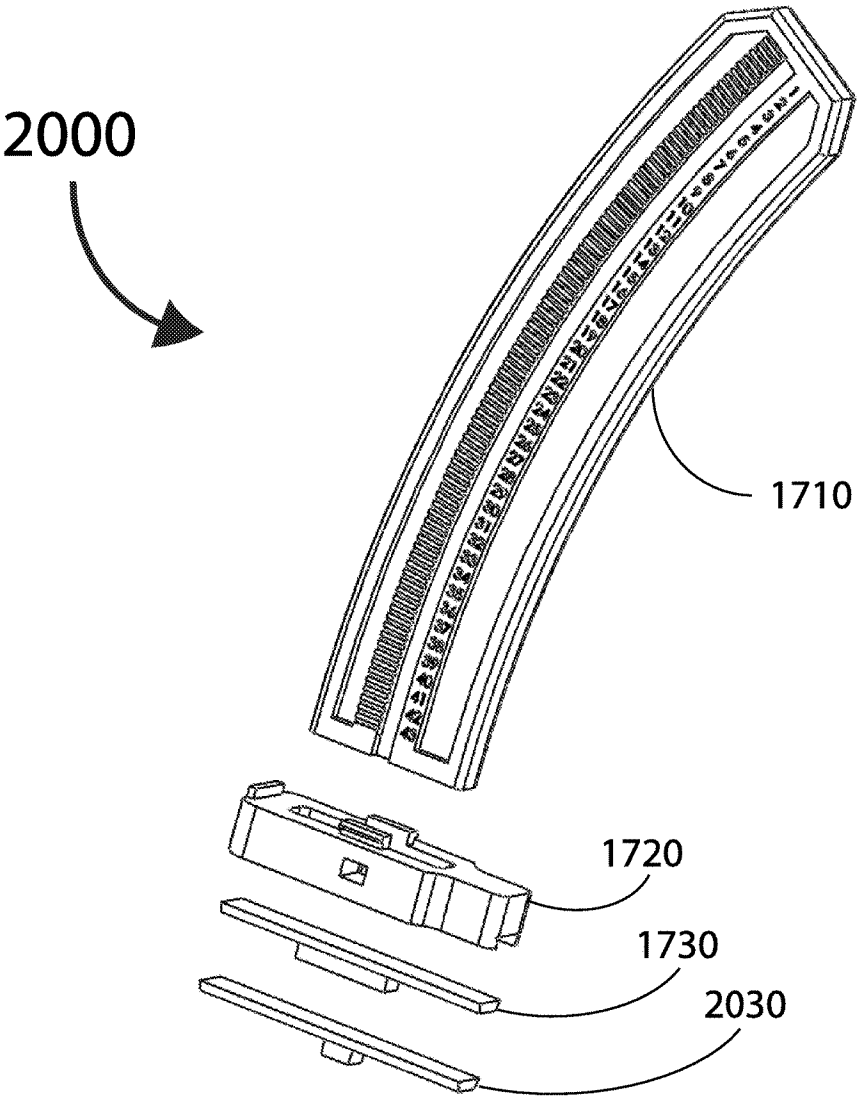
FIGS. 20A-20B illustrate another embodiment of an interchangeable adjustable capacity limiting assembly in accordance with the present invention.
Figure 20B:
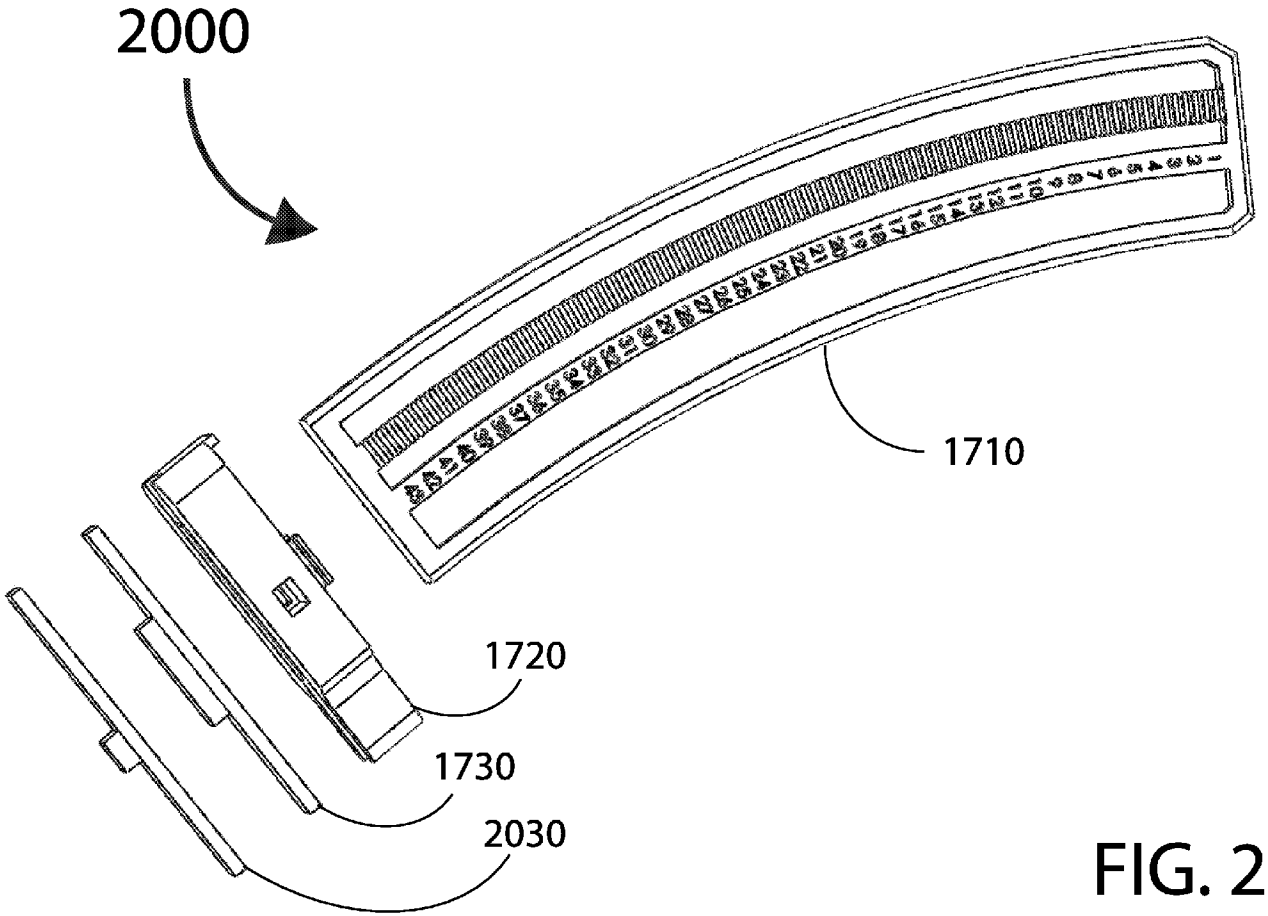

FIGS. 20A-20B illustrate yet another embodiment of a universal interchangeable adjustable-capacity limiting assembly kit 2000 in accordance with the present invention. Limiting assembly kit 2000 includes limiter body 2010, limiter base 1720, and optional magazine base lock 1730. Kit 2000 can also include an alternate optional magazine base lock 2030 configured to fit a different firearms magazine (not shown) with a magazine base plate having a smaller corresponding co-locating hole.

Many modifications and additions to the above described embodiments are possible. In another implementation, the spacing of the first and the second plurality notches may not match each other. For example, to save costs, a hybrid 9 mm/40 S&W limiter body may be configured for either a 9 mm or a 40 S&W magazine.

In yet another implementation, the spacing of the first and the second plurality notches may match each other but are offset with respect to each other. Hence, since magazine bodies of the same cartridge caliber for two different firearms may be offset relative to each other, it may be possible to share such an offset limiter body between two different brands of magazines having the same cartridge caliber.

Figure 21A:
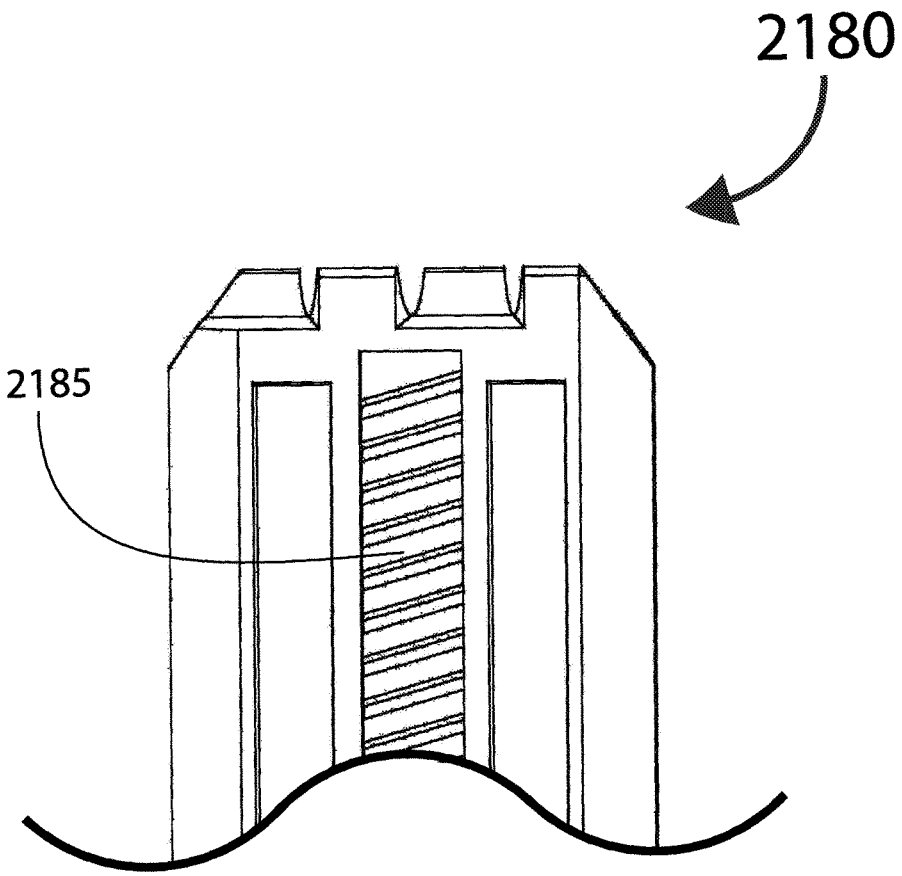
FIGS. 21A and 21B depict an embodiment of a universal magazine limiter in accordance with the present invention.
Figure 21B:
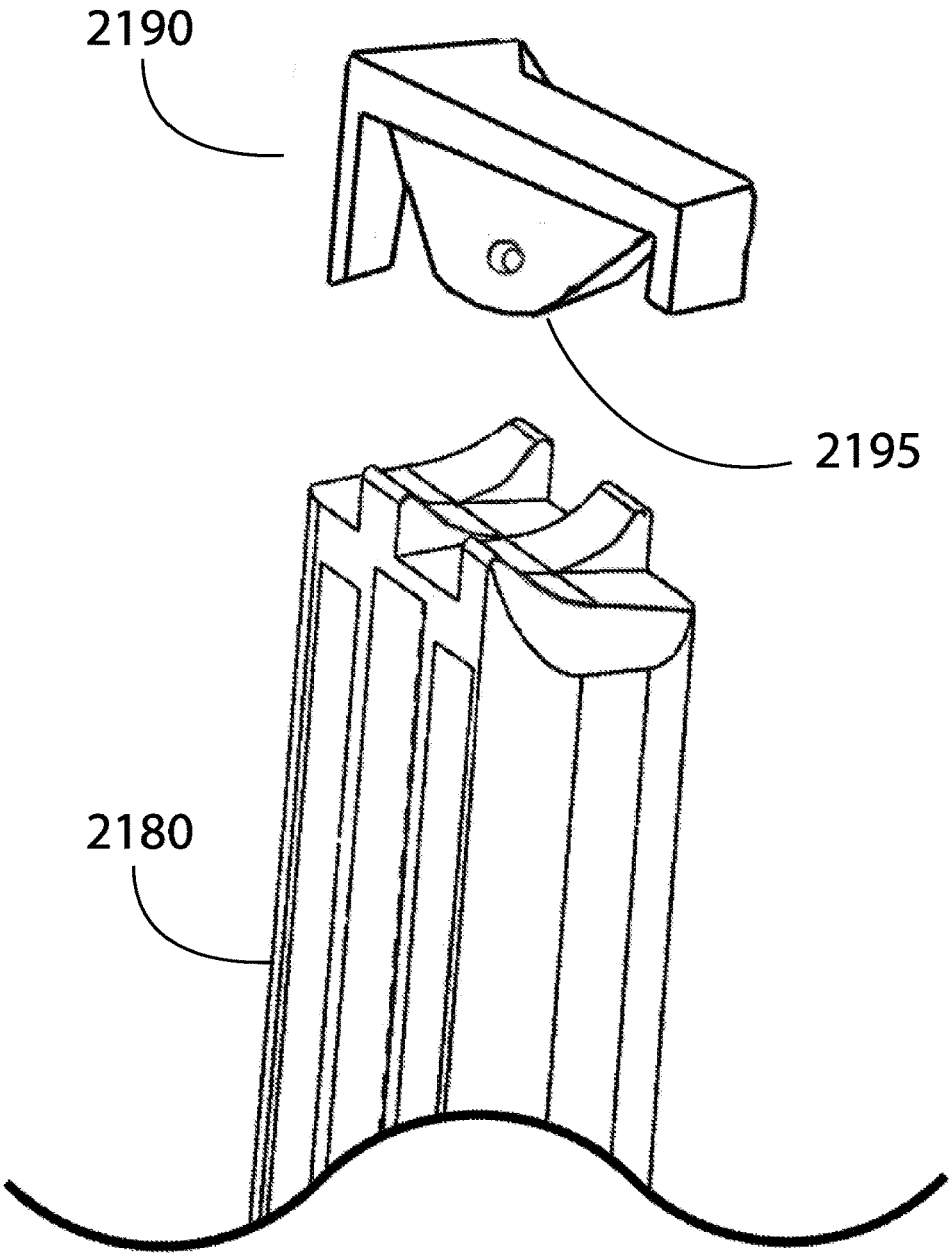

FIGS. 21A and 21B are side and perspective views, respectively, depicting an embodiment of a universal magazine limiter 2180 which can be adapted to different firearms by swapping the appropriate cartridge follower 2190. Note that cartridge follower 2190 has a rounded bottom 2195 configured to rest snugly to a cupped top interface of magazine limiter 2180. In this embodiment, universal limiter 2180 has a plurality of notches 2185 corresponding to a plurality of magazine capacities, thereby enabling a user to configure the magazine by merely sliding a limiter base (not shown, but similar functionally to limiter base 1020 of limiter assembly 1000).

Figure 22:
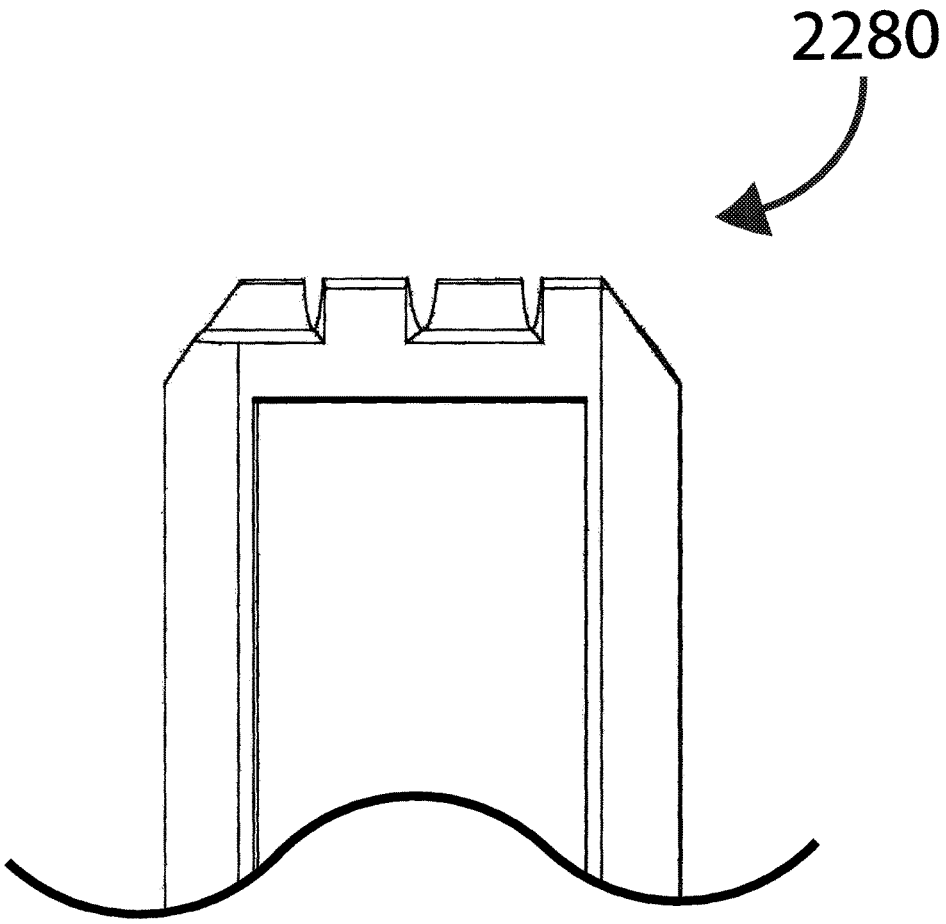
FIG. 22 illustrates another embodiment of a universal magazine limiter in accordance with the present invention.

FIG. 22 illustrates another embodiment of a universal magazine limiter 2280, a variant of the universal magazine limiter 2180. In this embodiment, magazine limiter 2280 does not have notches and hence has a predetermined capacity-limiting feature, but is easier to manufacture, e.g., using a molding process.

Figure 23:
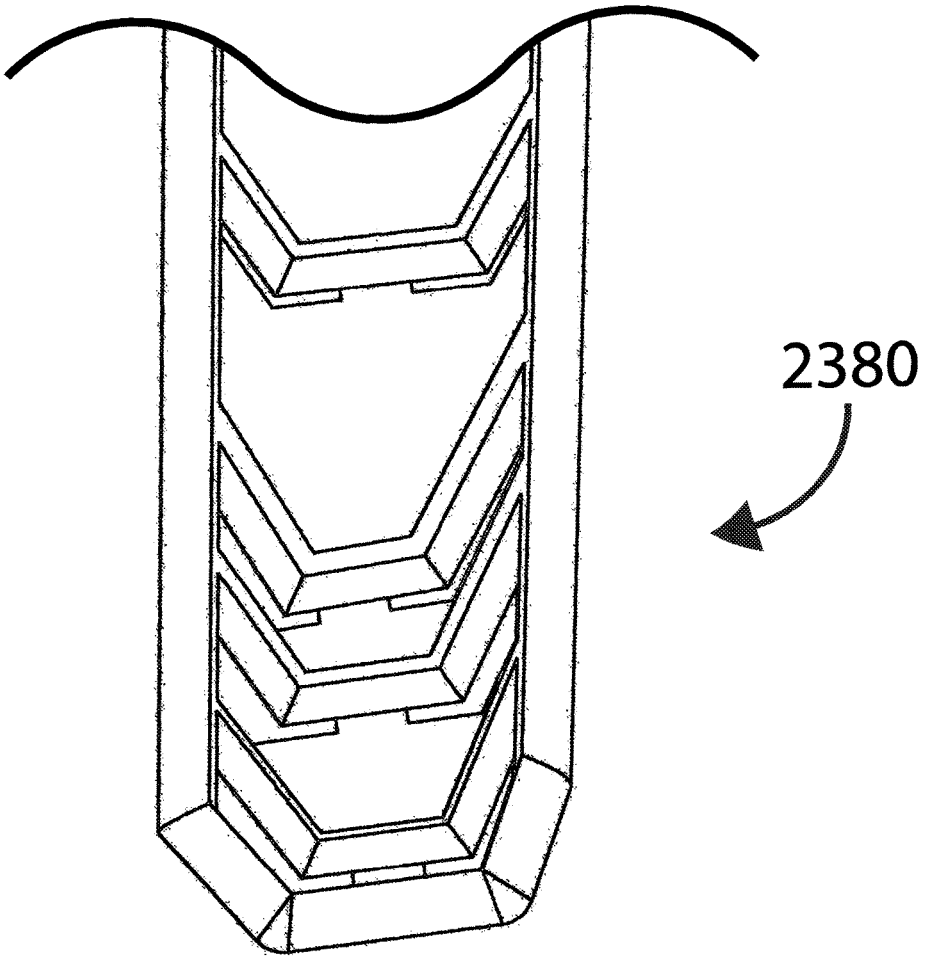
FIG. 23 depicts a variant of the universal magazine limiter of FIG. 22 with have one or more detachable extensions corresponding to one or more magazine capacities, in place of notches.

In some embodiments, as depicted by exemplary universal capacity-configurable magazine limiter of 2380 FIG. 23, in place of notches, a lower body portion of limiter 2380 may have one or more detachable extension(s) corresponding to one or more magazine capacity/capacities, for example, 5 rounds and/or 10 rounds.

Figure 24:
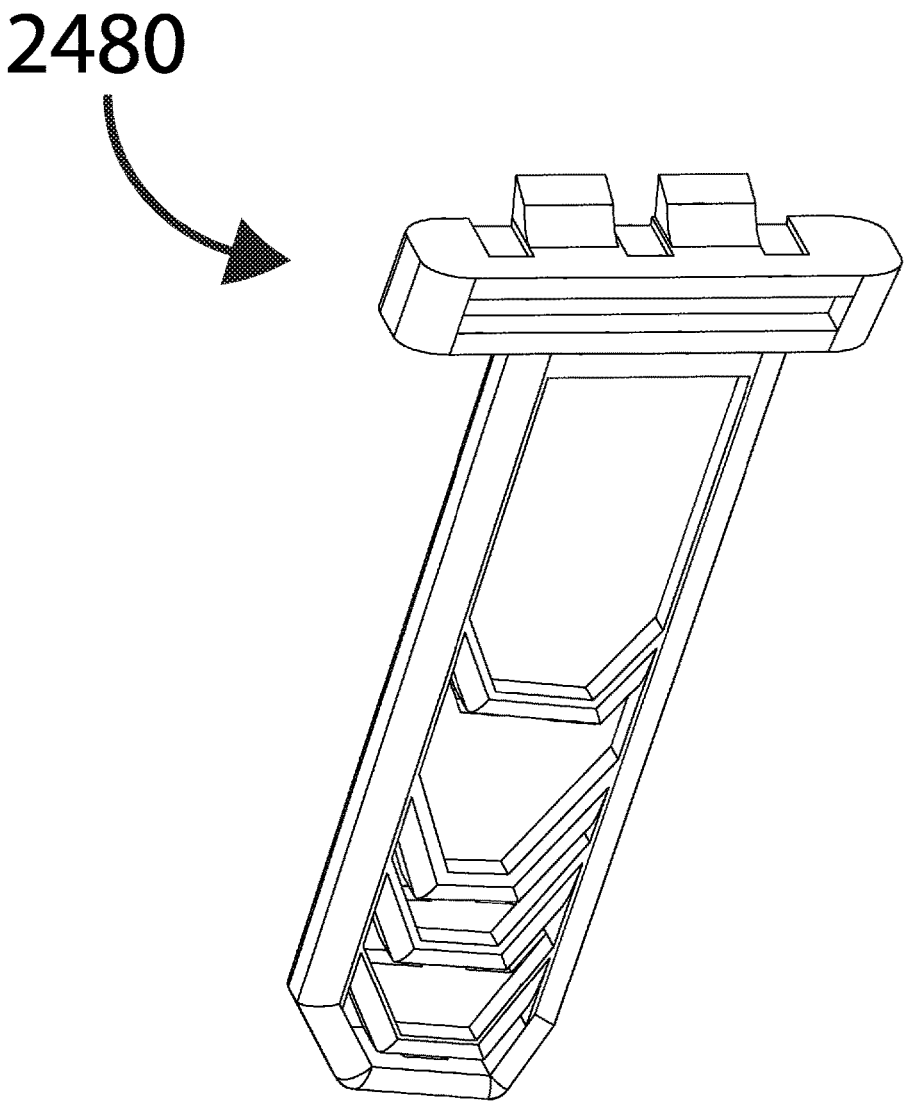
FIG. 24 illustrates yet another embodiment of a magazine limiter configured for a Glock compatible magazine in accordance with the present invention.
Figure 25A:
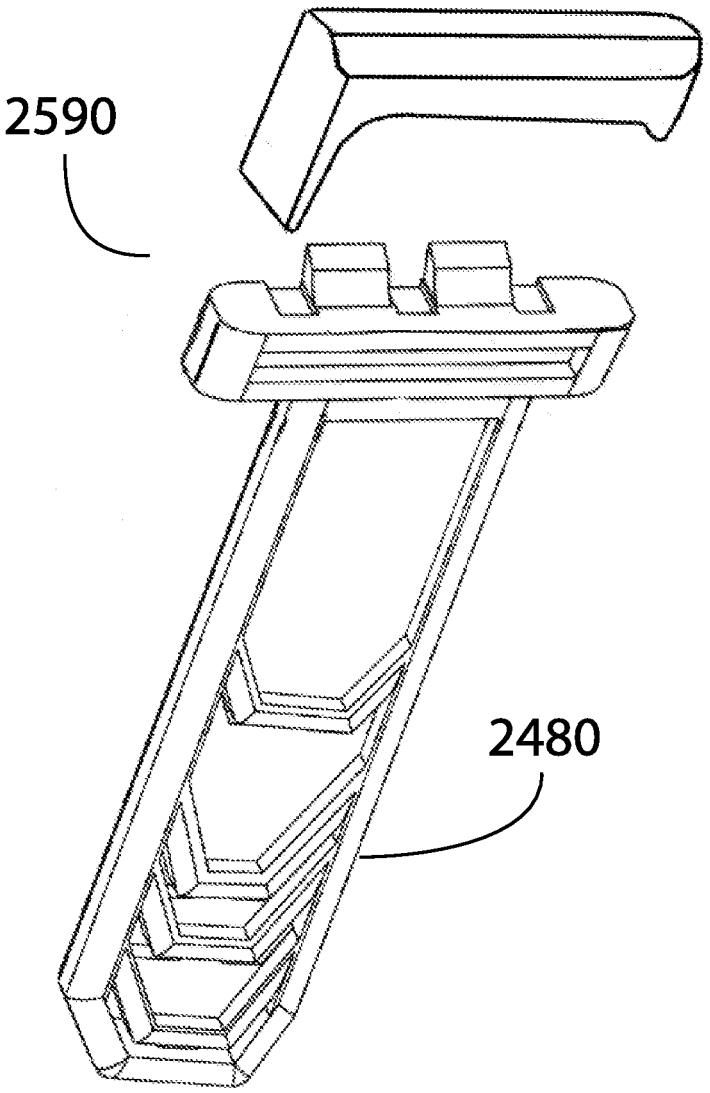
Figure 25B:
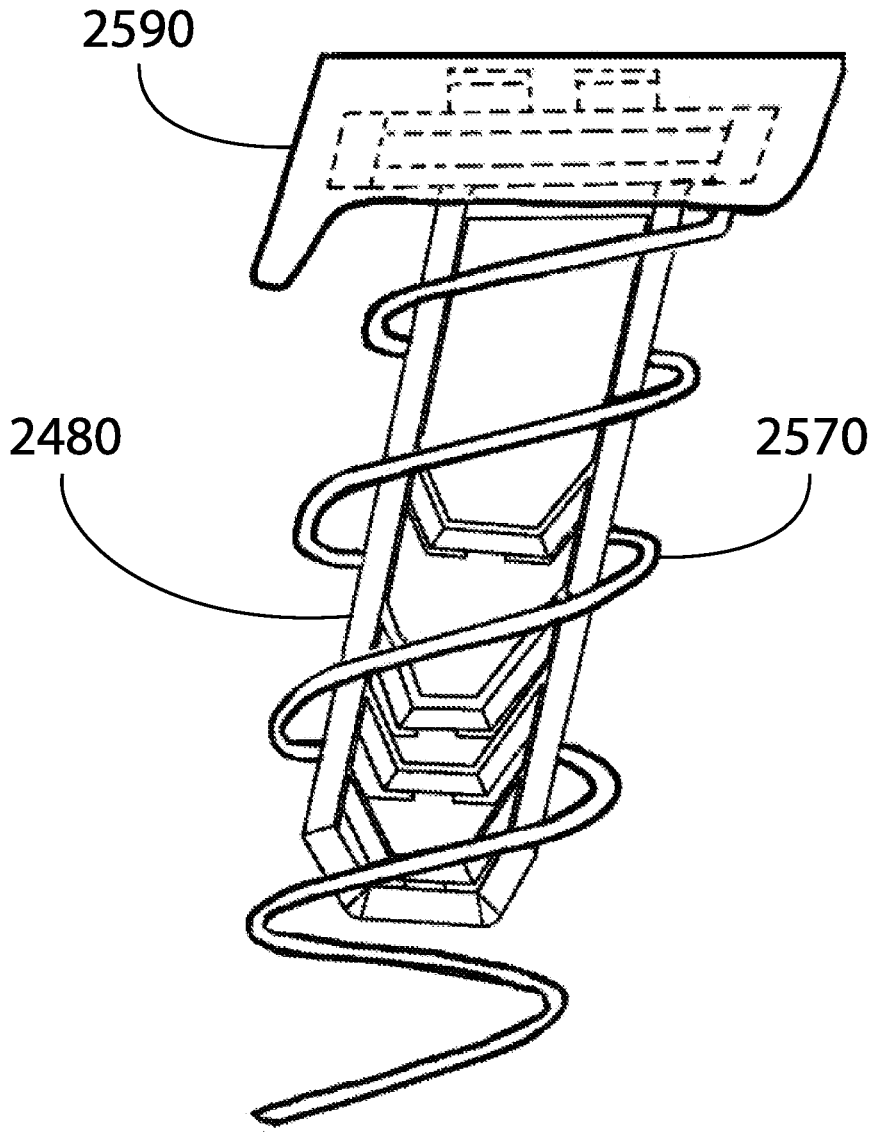
FIG. 25B depicts that limiter inserted into a magazine spring.
Figure 26:
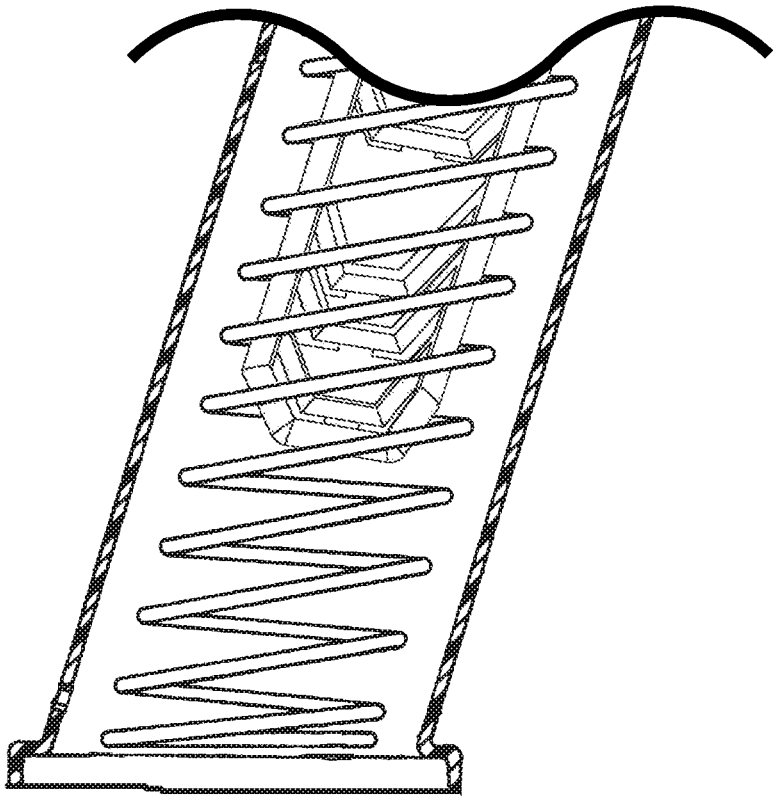
FIG. 26 is a cutaway view illustrating the limiter of FIG. 24 within a Glock compatible magazine body.

FIG. 24 illustrates yet another embodiment of a magazine limiter 2480 configured for a Glock and/or Glock compatible magazine. In this embodiment, the lower body portion of limiter 2480 may have one or more detachable extension(s) corresponding to one or more magazine capacities, for example, 5 rounds and/or 10 rounds. Referring to FIG. 25A, the limiter 2480 has been mounted under a compatible cartridge follower 2590. Next, as shown in FIG. 25B, the magazine limiter 2480 is inserted into a compatible magazine spring 2570. The limiter assembly of FIG. 25B can now be inserted into a Glock and/or Glock compatible magazine body, as depicted in the cutaway view FIG. 26.

Suitable materials for constructing the various capacity limiting assemblies of the present invention include materials strong enough to prevent deformation while in use, such as, but not limited to thermo moldable plastics, fiberglass impregnated nylon, carbon fiber composites, epoxy compounds, synthetic resins, aluminum alloys and sheet metal. Note that the various components, e.g., limiters, of the described embodiments may be assembled using joints such as dovetail slots and tongue and groove. These joints can be reinforced by the use of adhesives such as plastic cements or epoxy compounds, and/or by employing techniques such as ultrasonic bonding or heat bonding.

The advantages of the present invention also include, without limitation, the ability to quickly and economically reduce the capacity of cartridge magazines in production or future production using the existing magazine parts. Complex parts such as the magazine follower, which is critical for reliable function, do not need to be replaced. Spring tension and structure need not be altered. Further the outward shape and appearance of the magazine which can affect handling characteristics is not compromised. In the above described embodiments, magazines cannot be readily converted back to higher capacity without disassembly of the magazine. In some embodiments, the limiting assembly may also be permanently attached to the magazine spring, which prevents reassembly of the magazine in a higher capacity, while allowing for cleaning and maintenance of the magazine.

While this invention has been described in terms of several embodiments, there are alterations, modifications, permutations, and substitute equivalents, which fall within the scope of this invention. It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A universal adjustable magazine capacity limiting assembly configured to limit a cartridge capacity of a firearm magazine having a magazine body, a magazine spring, a cartridge follower and a magazine floor plate, the universal magazine capacity limiting assembly comprising:

a configurable magazine capacity limiter body having a top edge configured to securely operate with the cartridge follower of the firearm magazine, the cartridge follower configured to be operatively coupled to a top of the magazine spring of the firearm magazine, wherein the limiter body is configured to be installed substantially within coils of the magazine spring, and wherein the limiter body is further configured to limit the travel of the cartridge follower within the magazine body thereby limiting a cartridge capacity of the firearm magazine;

wherein a lower portion of the limiter body includes a plurality of removable extensions configured to be severed at a corresponding plurality of pre-determined locations thereby enabling a corresponding plurality of cartridge capacities for the firearms magazine; and wherein the top edge of the limiter body includes a cupped section configured to be securely coupled the cartridge follower, and wherein the cartridge follower is configured for a type of magazine corresponding to a type of firearm.

2. A firearm magazine having a universal capacity limiting assembly configured to limit a cartridge capacity of the firearm magazine, the firearms magazine comprising:

a magazine body;

a cartridge follower;

a magazine spring;

a magazine floor plate;

a configurable magazine capacity limiter body having a top edge configured to securely operate with the cartridge follower of the firearm magazine, the cartridge follower configured to be operatively coupled to a top of the magazine spring of the firearm magazine, wherein the limiter body is configured to be installed substantially within coils of the magazine spring, and wherein the limiter body is further configured to limit the travel of the cartridge follower within the magazine body thereby limiting a cartridge capacity of the firearm magazine, wherein a lower portion of the limiter body includes a plurality of removable extensions configured to be severed at a corresponding plurality of pre-determined locations thereby enabling a corresponding plurality of cartridge capacities for the firearms magazine; and wherein the top edge of the limiter body includes a cupped section configured to be securely coupled the cartridge follower, and wherein the cartridge follower is configured for a type of magazine corresponding to a type of firearm.

3. A universal adjustable magazine capacity limiting assembly configured to limit a cartridge capacity of a firearm magazine having a magazine body, a magazine spring, a cartridge follower and a magazine floor plate, the magazine capacity limiting assembly comprising:

an interchangeable magazine capacity limiter body having a top edge configured to securely operate with the cartridge follower of the firearm magazine, the cartridge follower configured to be operatively coupled to a top of the magazine spring of the firearm magazine, wherein the limiter body is configured to be installed substantially within coils of the magazine spring, and wherein the limiter body is further configured to limit the travel of the cartridge follower within the magazine body thereby limiting a cartridge capacity of the firearm magazine, wherein the limiter body is further configured to be severed at a plurality of pre-determined locations thereby enabling a corresponding plurality of cartridge capacities for the firearms magazine, and wherein the limiter limited body includes a corresponding plurality of notches corresponding to the plurality of pre-determined locations and the plurality of cartridge capacities;

wherein the top edge of the limiter body includes a cupped section configured to be securely coupled the cartridge follower, and wherein the cartridge follower is configured for a type of magazine corresponding to a type of firearm; and an interchangeable magazine capacity limiter base configured to be securely coupled to the magazine limiter body, wherein the limiter base includes a catch configured to securely engage one of the corresponding plurality of notches, and wherein the limiter base is also configured to be operatively coupled to a magazine floor plate of the firearm magazine.

* * * * *